US005207523A

United States Patent [19]

Wittek

[11] Patent Number: 5,207,523

[45] Date of Patent: May 4, 1993

[54] WRITING IMPLEMENT WITH FORWARD AND REARWARD SEALS

[75] Inventor: Götz-Ulrich Wittek, Munich, Fed. Rep. of Germany

[73] Assignee: Intergraph Office Innovation N.V., Netherlands

[21] Appl. No.: 479,202

[22] Filed: Feb. 13, 1990

Related U.S. Application Data

[63] Continuation of Ser. No. 159,449, Feb. 18, 1988, abandoned, which is a continuation of Ser. No. 762,196, Jul. 18, 1985, abandoned.

[30] Foreign Application Priority Data

Nov. 18, 1983 [DE] Fed. Rep. of Germany ..... 3341759
Oct. 17, 1984 [DE] Fed. Rep. of Germany ..... 3438074

[51] Int. Cl.[5] ..... B43K 9/00
[52] U.S. Cl. ..... 401/107; 401/108
[58] Field of Search ..... 401/107, 108

[56] References Cited

U.S. PATENT DOCUMENTS

| | | | |
|---|---|---|---|
| 350,037 | 9/1886 | Bussler | 401/108 |
| 3,480,370 | 11/1969 | Koeln . | |
| 3,525,573 | 8/1970 | Fend | 401/108 |
| 4,575,271 | 3/1986 | Hashimoto et al. | 401/108 |

FOREIGN PATENT DOCUMENTS

| | | | |
|---|---|---|---|
| 506766 | 10/1954 | Canada | 401/107 |
| 1284326 | 11/1968 | Fed. Rep. of Germany | 401/107 |
| 1561795 | 4/1970 | Fed. Rep. of Germany | 401/107 |
| 1561796 | 4/1970 | Fed. Rep. of Germany | 401/107 |
| 1561812 | 4/1970 | Fed. Rep. of Germany | 401/107 |
| 1424491 | 12/1965 | France | 401/107 |
| 1438554 | 4/1966 | France | 401/107 |
| 87163 | 5/1966 | France | 401/108 |
| 57-2797 | 1/1982 | Japan . | |
| 581030 | 11/1974 | Switzerland | 401/107 |
| 299676 | 11/1928 | United Kingdom | 401/108 |

*Primary Examiner*—Steven A. Bratlie
*Attorney, Agent, or Firm*—Handal & Morofsky

[57] ABSTRACT

The writing implement comprises a sleeve-shaped housing (1) in which an inner sleeve (7) is disposed includes a writing element (2). At the tip-side end of the inner sleeve (7) is disposed a hermetic closure portion (8) which comprises a plurality of segments (34) which are biassed radially outwardly and which in the closure position (FIG. 7 ), bear on each other forming a seal beyond the nib (26) and which are provided with sealing bead segments (23) which also bear on each other forming a seal behind the tip of the writing element (26) and which bear on the tip segment (4) of the writing element (2), so that the nib portion (26) of the writing element is closed in an overall hermetically sealing chamber (6). The writing implement uses a mechanism which facilitates, while pressing the actuating element (11), the premature opening of the closure element (8) before the exit of the writing element (2) therefore avoiding contact with the nib (26). The co-ordination between closure portion (8) and writing element (2) can be reached by several means.

13 Claims, 27 Drawing Sheets

Figure 1:
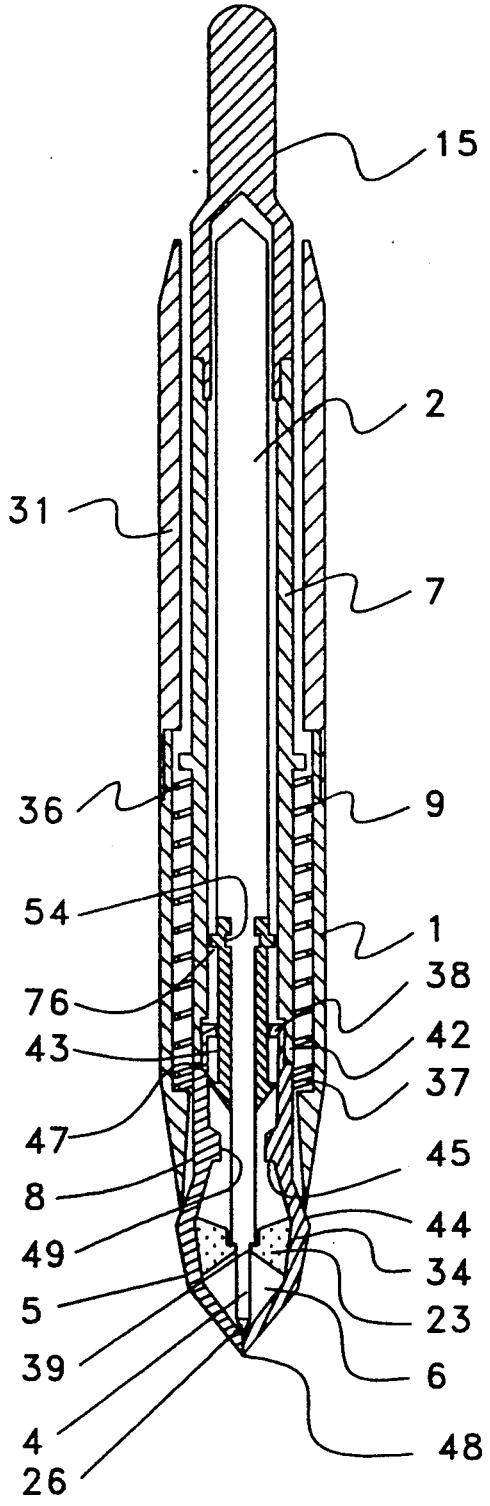

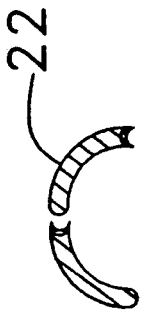
FIG. 15a
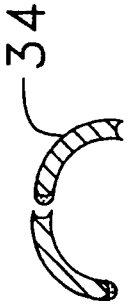
FIG. 15b
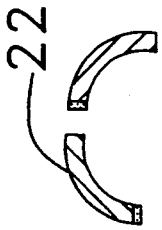
FIG. 15 c
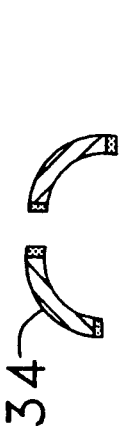
FIG. 15d
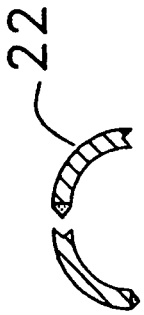
FIG. 15e
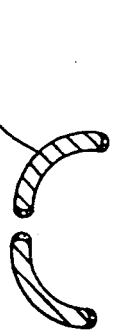
FIG. 15f
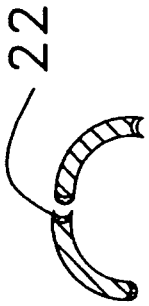
FIG. 15g
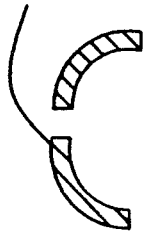
FIG. 15h
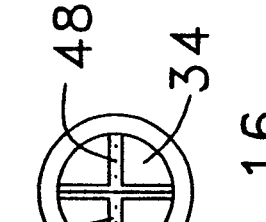
FIG. 17
FIG. 16

WRITING IMPLEMENT WITH FORWARD AND REARWARD SEALS

This application is a continuation of application Ser. No. 159,449, filed Feb. 18, 1988 which is a continuation of Ser. No. 762,196 filed Jul. 18, 1985 both abandoned.

DESCRIPTION

The invention relates to a writing implement comprising a sleeve-shaped housing and a writing element which is disposed in said housing and which is displaceable between a writing reading position freeing the tip portion of the writing element serving for writing and a storage position retracted into the housing, the housing portion adjacent the tip portion of the writing element consisting of segments which in the writing readiness position are radially spread apart and in the storage position bear on each other and close the housing on the tip side.

Such a writing implement is known for example from DE-OS 2,751,304. In this known writing implement the segments which in the storage position of the writing element are to close the writing implement housing on the tip side are made integrally with the housing of the writing implement. The closure pressure of the segments is produced by the resiliency of the material of the housing when said segments on transition from the storage position to the writing readiness position are spread apart by a corresponding shoulder at the writing element against the resilient resistance of the housing material. When the writing element is retracted from the writing readiness position into the storage position the shoulder at the writing element releases the segments again so that the latter can now move radially inwardly due to their resiliency. The purpose of this known arrangement is to protect the tip or nib of the writing element or drawing element when not in use.

This known writing implement has the considerable disadvantage that although the nib can be protected when not in use from mechanical damage it is however not possible to cause the segments in the storage position to lie so closely on each other that they can hermetically seal the housing on the nib side in order to effectively prevent a drying out of the nib of the writing element. Furthermore, because only the material resiliency ensures the closure pressure, in the course of time the closing ability of the nib compartment of the known writing implement will decline due to natural fatigue.

The invention is therefore addressed to on the problem of providing a writing implement of the type described above which with relatively simple design and handling can effectively prevent writing elements or their nibs, for example felt-tipped pencils, Indian or drawing-ink pens, fountain pens, capillary writing pens, Indian ink or drawing brushes or the like, from drying out in the storage position of the writing implement.

This problem is solved through the invention of a writing implement of the type described above wherein the housing consists of an outer sleeve and an inner sleeve which is disposed substantially within the outer sleeve relatively displaceable with respect to the latter in the axial direction to a limited extent, the segments forming the closure portion of the housing are mounted on the inner sleeve and lie partially outside the outer sleeve, said segments projecting radially outward under pretension, the port of the closure portion lying outside the outer sleeve having a greater external diameter than the internal the tip or nib-end of the outer sleeve which tapers in the direction towards the housing interior substantially to the diameter of the inner sleeve, said inner sleeve being biassed via a spring bearing on the outer sleeve in the direction towards the storage position, the spring pressure being converted by the interaction between the tapering portion of the closure portion and the tip-side opening of the outer sleeve to a radial closure pressure of the segments, and said inner sleeve being axially displaceable against the pressure of the spring by means of an actuating element.

In this writing implement, according to the invention, the closure pressure of the closure portion or of the segments of the closure portion is not ensured by the material resiliency or elasticity but by the spring pressure which can be selected in accordance with the requirements and which is converted by the cooperation between closure tip and housing of the writing implement to the closure pressure. As a result a closure pressure adequate for hermetic sealing can be produced and also maintained. If necessary, when fatigued, the tensioning spring can be replaced without any problems. In addition, a collision of the writing element tip with the closure portion is effectively avoided because the closure portion is first opened and only then is the writing element displaced forwardly.

Advantageously, when the writing implement is brought by its own weight into the writing readiness position or into the storage position said writing element can be provided with projections for limiting the axial movement of the writing element which cooperate with inner beads on the intermediate sleeve in order to be able to fix the writing element in the writing readiness position. It may be advantageous to dispose said projections on a separate function sleeve which is adapted to be pushed onto the front portion of the writing element and which can possibly remain in the housing when the writing element is changed.

It may also be advantageous to provide the housing with an extension which engages over the closure portion in the storage position and thus protects it from mechanical damage.

In a writing implement of the known type, in which the writing element is biassed by means of a spring bearing on the housing in the direction towards the storage position and adapted to be fixed in the writing readiness position relative to the housing by means of a shift mechanism actuable by the actuating element against the spring pressure, the problem outlined above is efficiently solved where the spring biassing the writing element against the housing bears on the inner sleeve, the shift mechanism engages on the outer sleeve, the return force of the spring biassing the writing element against the inner sleeve is smaller than that of the spring biassing the inner sleeve against the outer sleeve, and the inner sleeve is fixed against the outer sleeve in the writing readiness position by interaction between the segments and writing element on the one hand and the outer sleeve on the other.

Substantially any of the known shift mechanisms may be used for displacing the intermediate sleeve and the writing element from the storage position to the writing readiness position and fixing them there.

In this case the writing element is usefully provided with a plurality of control projections which cooperate with the shift mechanism for fixing the writing element independently of the intermediate sleeve in the writing readiness position. The shift mechanism may advantageously consist of a separate shift ring which is disposed longitudinally displaceable between the intermediate sleeve and the outer sleeve and cooperates with guide grooves which are provided on the inner surface of the outer sleeve and with shift teeth which are provided on the actuating element.

Since the intermediate sleeve in this case must be slit for the passage of the control projections the actuating element is advantageously provided with recesses in which the end edge of the intermediate sleeve can be accommodated for stabilization.

In another version the shift mechanism can engage on the inner sleeve of the housing, the return force of the spring biassing the writing element against the inner sleeve then being greater than that of the spring biassing the inner sleeve against the outer sleeve.

The springs are to be so dimensioned that upon use of the actuating element the pressure on two springs first has an effect only on the spring supporting the intermediate sleeve against the housing so that until the closure portion has adequately opened the writing element cannot be displaced relatively to the intermediate sleeve.

This securing may be additionally supported by projections which are provided at the inner side of the segments of the closure portion and which engage in a corresponding shoulder of the writing element so that the latter cannot be axially displaced relatively to the intermediate sleeve until the closure portion has sufficiently opened. The spring travel of the spring supporting the intermediate sleeve against the housing can be restricted by a corresponding geometrical dimensioning of the spring or by a retaining projection at the intermediate sleeve which limits the axial displacement of the intermediate sleeve and thus the spring travel.

It may be of particular advantage for a part of the shift mechanism to be made integrally with the writing element. In this case the intermediate sleeve can be a short half sleeve which efficiently comprises a flange at the rearwardly directed end on which the spring pretensioning the intermediate sleeve against the writing element bears via slidable rings.

Within the intermediate sleeve a further sleeve coaxial therewith, can be disposed which is biassed instead of the writing element against the intermediate sleeve. Said intermediate sleeve may be retained by suitable retaining projections or beads in the intermediate sleeve against the spring pressure. In addition, a fountain pen system may be disposed in said intermediate sleeve.

To permit a particularly simple cartridge or writing element change, the intermediate sleeve may be made open at its rearward ward end and the cartridge or writing element provided with a grip extension for extraction.

To improve the hermetic sealing action of the segments the edges thereof bearing on each other may be provided with a seal and/or profiled complementary to each other.

To still further considerably improve the sealing effect and protection from drying, sealing lead segments may be disposed on the segments of the closure portion on the side facing the writing element which will make contact in the storage position, with each other and on the writing element and thus form, with the closure portion segment edges bearing on each other a hermetically sealed chamber surrounding the writing element tip portion.

It suffices, and may even be beneficial, for the seals provided at the segment edges to extend in each case only from the segment tip up to the height of the sealing bead segments. This may make it simpler to make the entire closure portion from one part because the seal then need only be disposed in the further expandable portion of the closure part.

It may be more efficient for the individual segments to be made separately and mounted and held in an intermediate ring secured detachably to the intermediate sleeve. This ring may consist effectively of elastic material in which the segments are mounted inclined outwardly to the axial direction of the intermediate ring so that the resiliency of the intermediate ring supports the radial pretensioning of the segments.

It is also possible to provide on the writing element at a point lying opposite the segments in the storage position a sealing ring (23') or coating (71) on which the segment inner faces come to bear and thus form with the sealing ring a hermetically sealed chamber (6) surrounding the tip portion of the writing element (2).

The formation of the refill tip with a sealing ring or a sealing coating has the advantage that the segment inner sides can be made without sealing bead elements and this considerably facilitates their production. In addition, this configuration according to the invention ensures that each time a refill is inserted at the same time a fresh seal for the chamber surrounding the tip portion of the writing element is also supplied. In addition, an sealing ring has the advantage in that it can serve as advance securing of the writing element in the storage position.

A particularly simple embodiment of the writing implement according to the invention provides that the inner surface regions of the segments are made complementary to the form of the tip portion of the writing element and in the storage position can come into contact with the refill tip itself forming a seal. This makes the provision of any sealing beads superfluous and further simplifies production of the writing implement. To improve the sealing action between the segments and the refill tip the inner surface of the segments may be made of rubber elastic provided with a rubber elastic coating. In the same way the surface of the refill tip in the engagement region may be made of rubber elastic.

A particularly favourable embodiment of the writing implement according to the invention for fountain pens is that the inner sleeve (74) is made partially shell-shaped and that the segment tip (8') is made, integrally, as partially shell-shaped closure portion which is connected via a resiliently outwardly pretensioned transition portion to the inner sleeve.

The partial shell-shaped configuration of the closure portion has the advantage that it can be adapted in the best possible manner to the contours of a fountain pen nib. In addition, the integral form of the closure portion makes production thereof considerably simpler.

Additionally, the inner sleeve can be formed integrally with the segment tip, thus making only one production step necessary.

To ensure a good sealing of the tip-side chamber in the closure portion a sealing bead element may be disposed which in the storage position comes into contact with the tip portion of the writing element forming a seal. Once again, this sealing bead segment can be made integrally with the closure member or portion.

With a closure member or portion consisting of several segments in a writing implement of the type mentioned above the edges of the individual segments may be connected together by thin-wall resilient segment connections which are folded inwardly in the storage position. This has the advantage that firstly no further seals need be provided on the segment edges and that secondly an absolutely tight sealing towards the side is ensured.

A writing implement of the type mentioned at the beginning can be further improved in that the inner sleeve consists of two cylinders of different diameter connected together, one spring being disposed outside the thinner and the other spring inside the thicker cylinder. This embodiment has the considerably advantage that the radial dimensions of the writing implement, in particular the outer housing of the writing implement, can be made smaller, whereby the entire writing implement is slimmer and thus has a more pleasant appearance.

To simplify the refill change in a writing implement of the type mentioned at the beginning it is of advantage for the outer sleeve (1) to be open towards the rear and the inner sleeve (7) in the storage position to project rearwardly out of the outer sleeve (1). The inner sleeve projecting rearwardly out of the outer sleeve makes it possible for the rear portion of the inner sleeve, which is connected via a thread to the front portion, to be screwed off to change the refill without having first to screw on the outer sleeve. This considerably facilitates refill insertion.

The closure action of the segments of the writing implement according to the invention can be improved in that the outer surfaces of the closure portion taper rearwardly in two steps of different inclination to the longitudinal axis, the portion of lesser inclination lying facing the tip or nib portion. The two-stage inclination configuration according to the invention ensures a two-stage closure operation. On closure of the writing implement the free edge of the tipside end of the outer sleeve first comes into contact with the greatly inclined outer surface region of the closure member or portion. This ensures that the writing element is first moved completely into the inner sleeve before the radial closure movement then starts very rapidly when the pronounced inclination is reached. On the other hand, by the weaker inclination of the outer surface of the closure member in the second closure stage a greater closure pressure of the segments against each other is achieved. As a result the sealing effect of the segment elements according to the invention is still further improved.

When using the writing implement according to the invention, more especially the closure mechanism according to the invention for capillary writing implements, said implement is so designed that on the inner side of the segment tip a sealing surface for the tip and the helix exit is disposed and that the actuating element acts on the inner sleeve and after a limited axial displacement of the inner sleeve comes into contact with the writing element, acts on the latter and displaces it axially. Firstly, the provision of the sealing face for the tip and the helix exit ensures that in the storage position of the writing implement no ink or the like can emerge from the capillary and the helix exit. Secondly, the configuration of the actuating element according to the invention ensures that even for example with an Indian ink pen simple operation by a push mechanism is achieved. By the actuating element acting on the inner sleeve before said element comes into contact with the writing element it is ensured that the capillary tip and the helix exit clear the sealing face before the radial opening movement of the segment tip to which the sealing face is secured starts. This effectively prevents any displacement of the capillary tip. By this configuration of the writing implement according to the invention for the first time an Indian ink or capillary writing implement is provided which without any cap which could be lost ensures an absolute tight sealing of the writing implement.

Figure 1A:
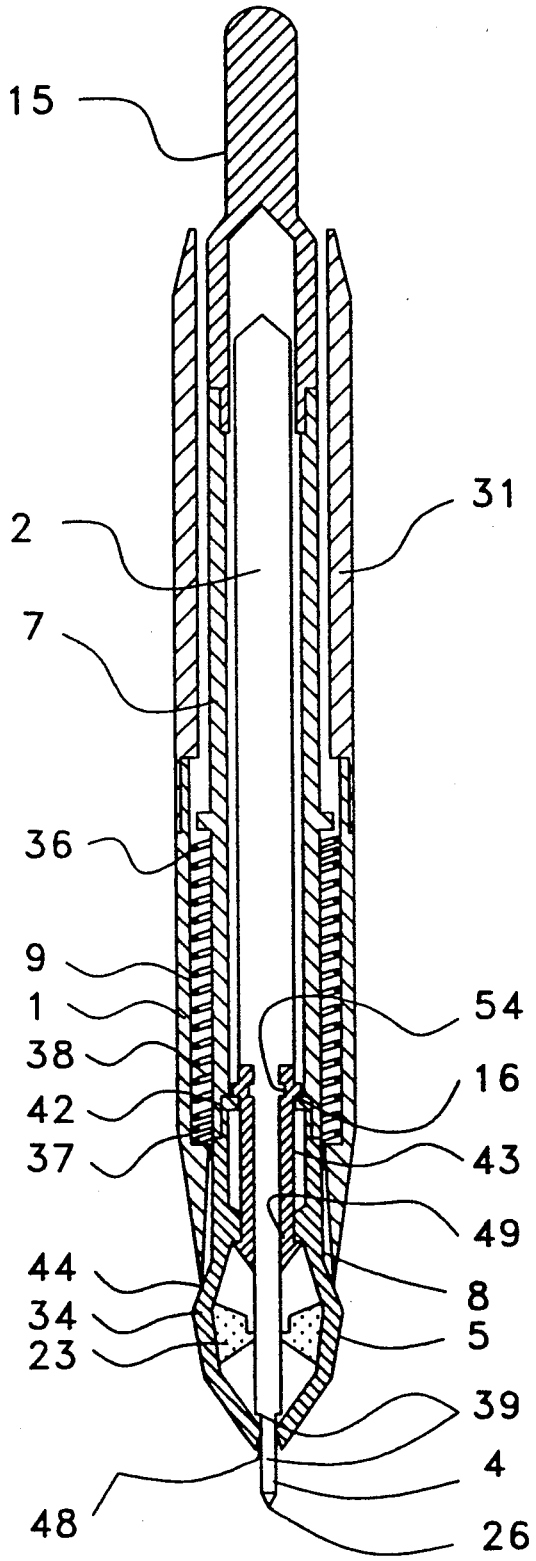
Figure 2:
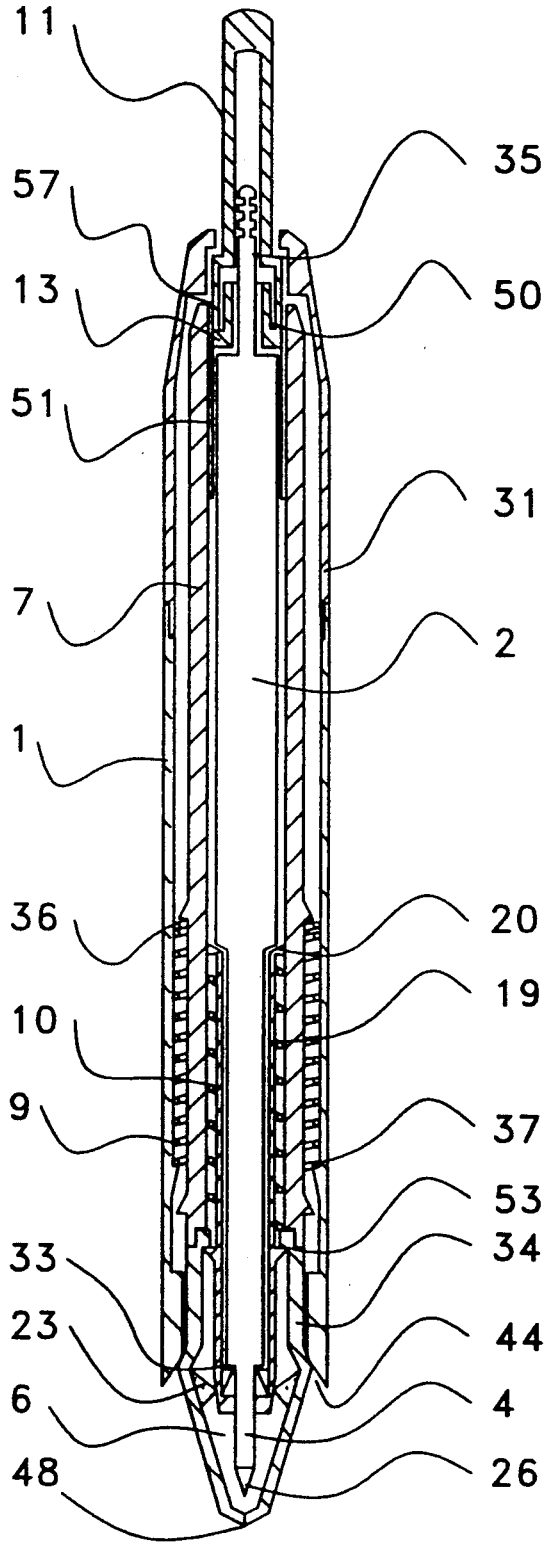
Figure 3:
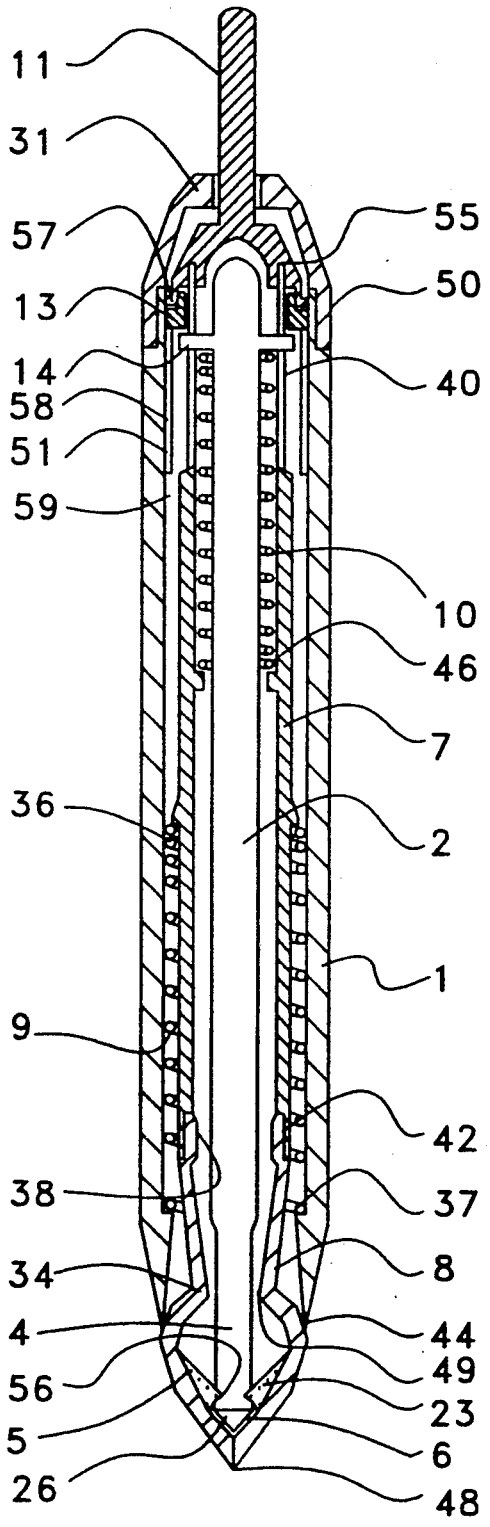
Figure 3A:
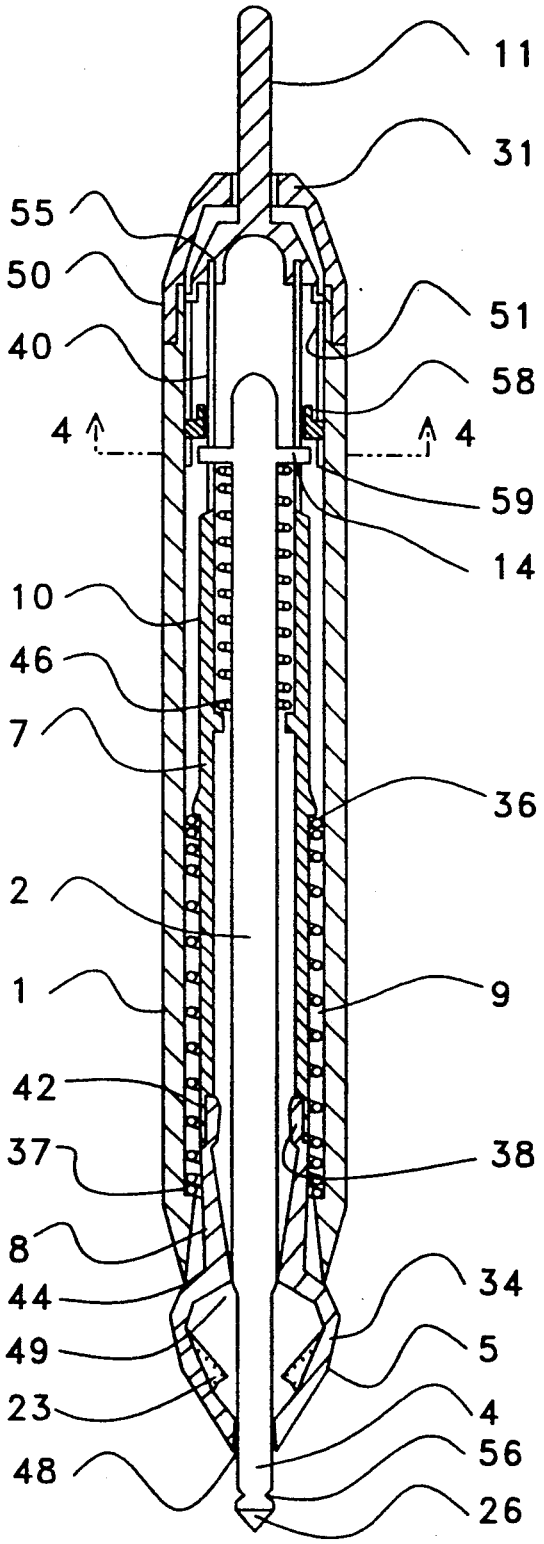
Figure 4:
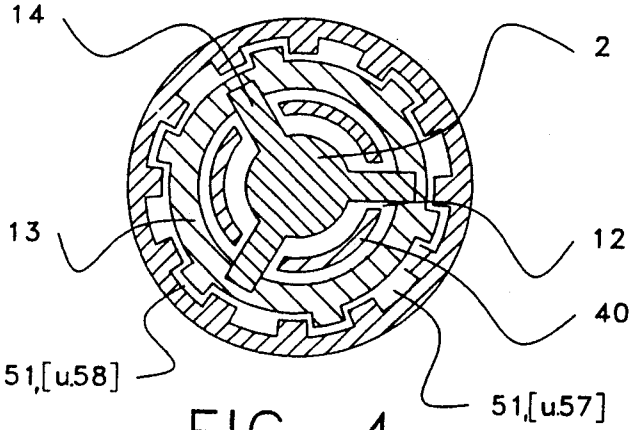
Figure 6:
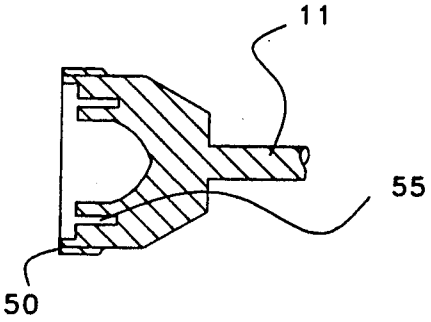
Figure 5:
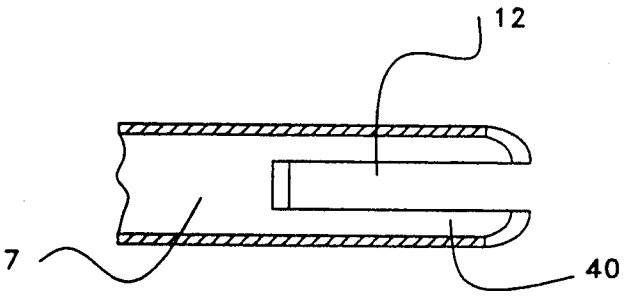
Figure 7:
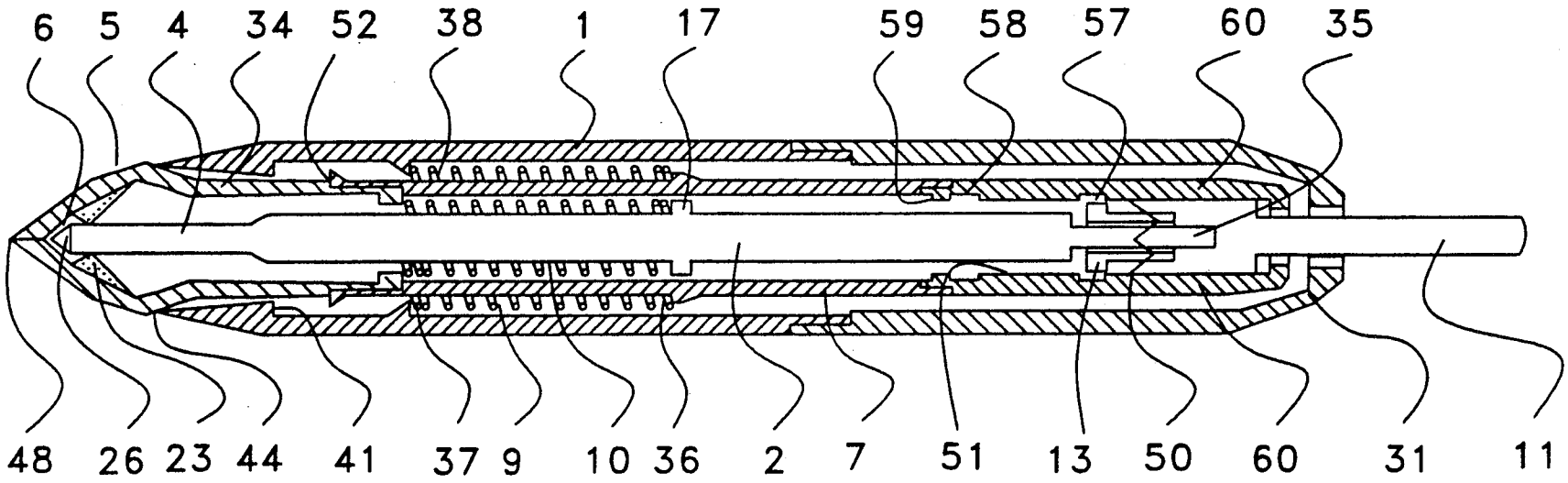
Figure 7A:
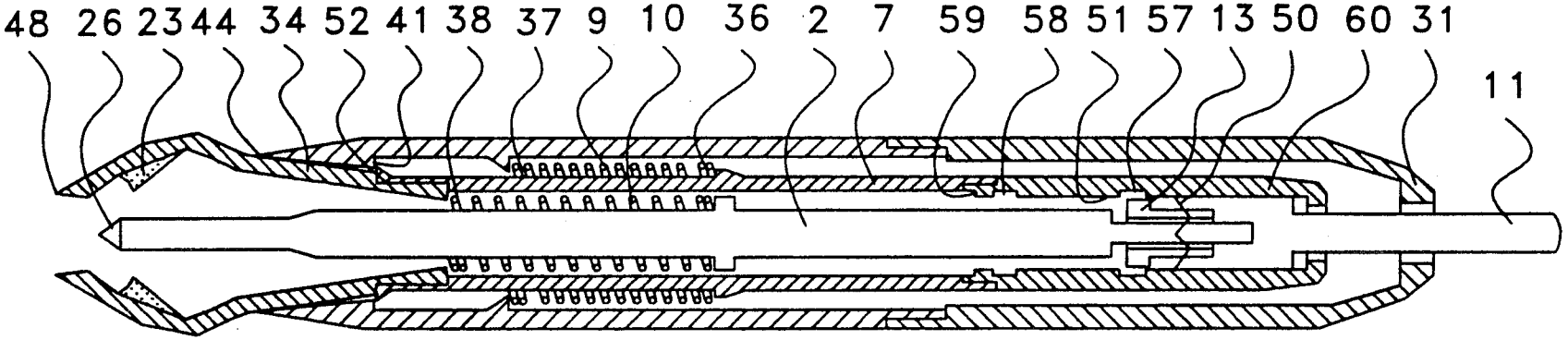
Figure 7B:
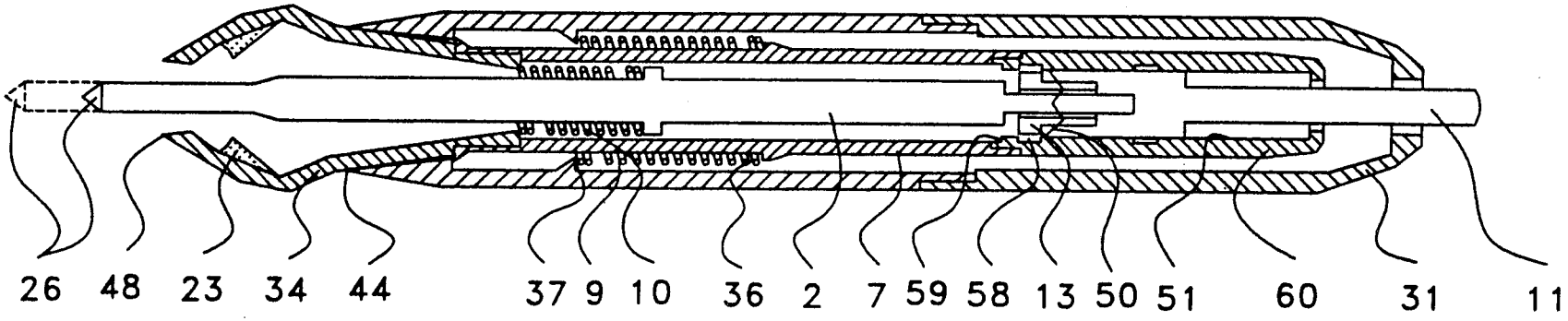
Figure 7C:
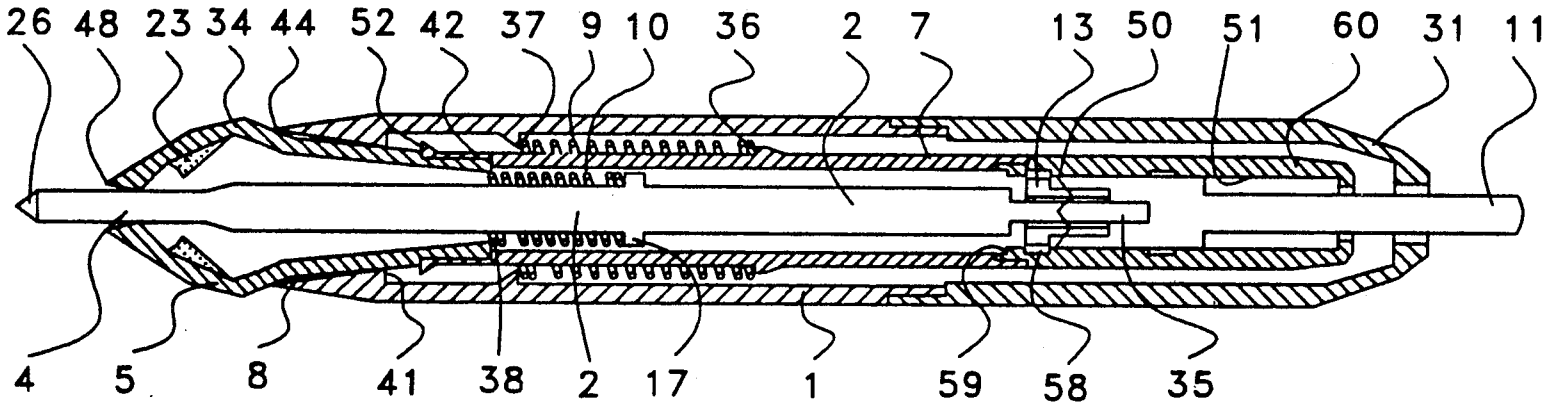
Figure 8:
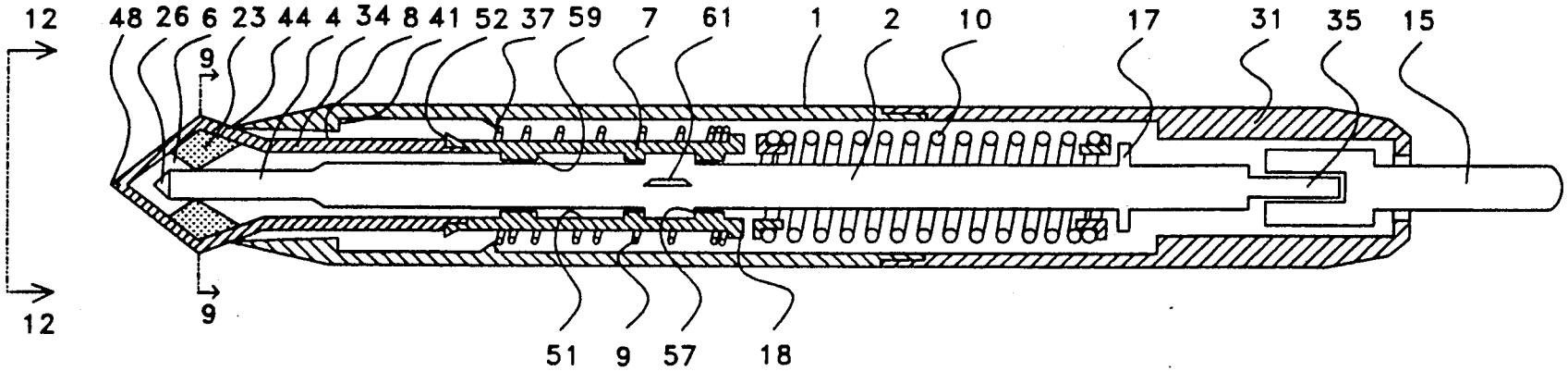
Figure 8A:
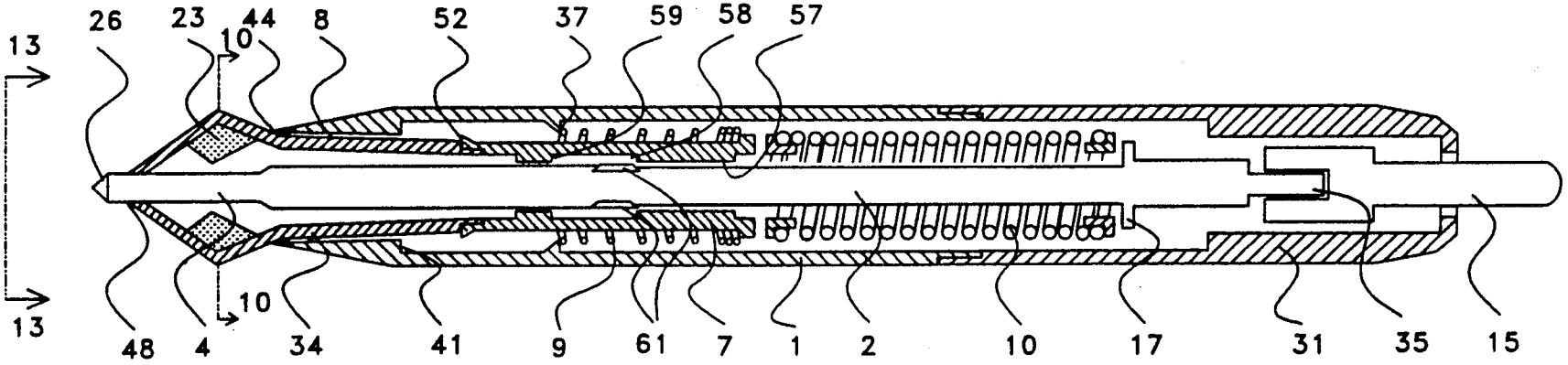
Figure 12:
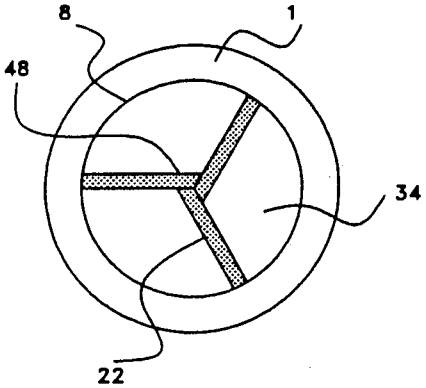
Figure 13:
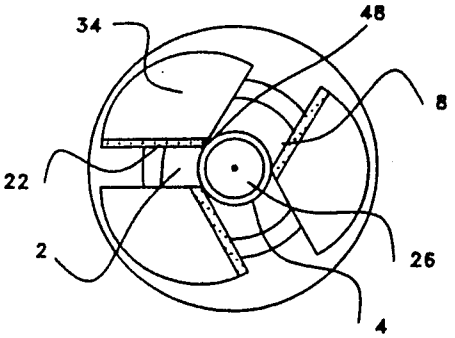
Figure 10:
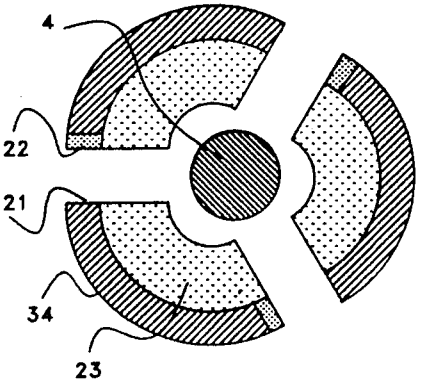
Figure 9:
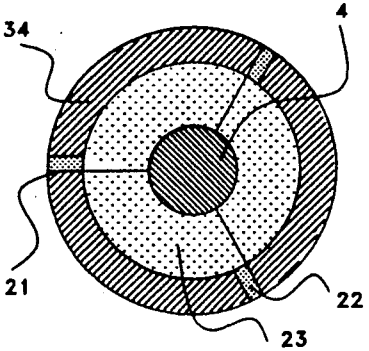
Figure 11:
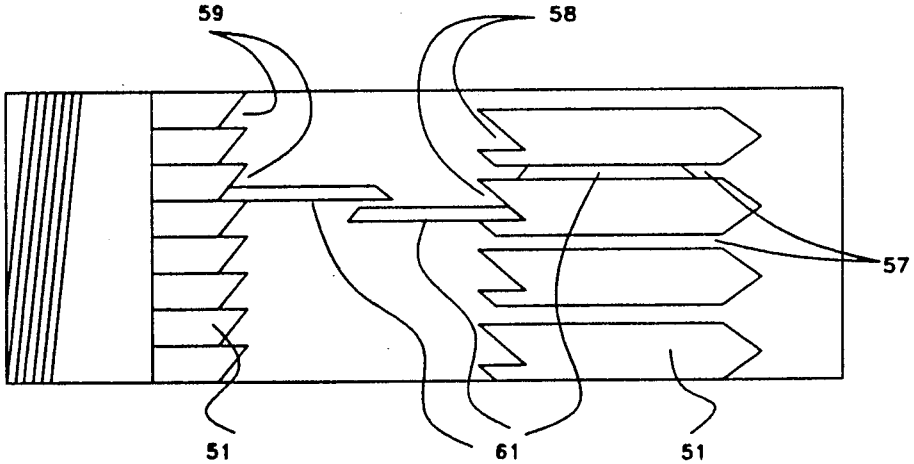
Figure 14:
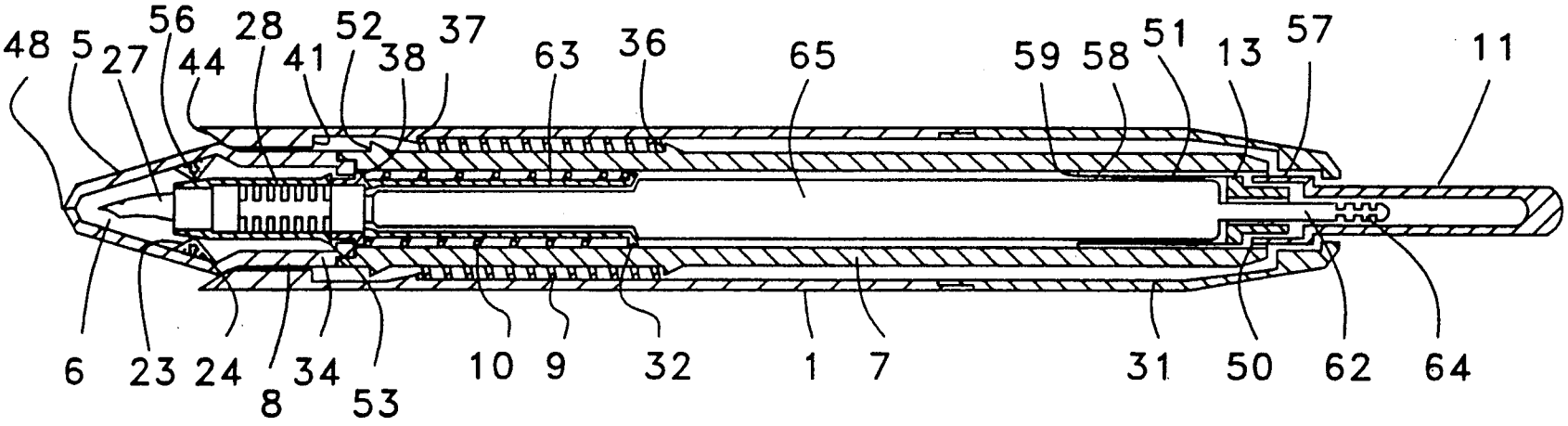
Figure 14A:
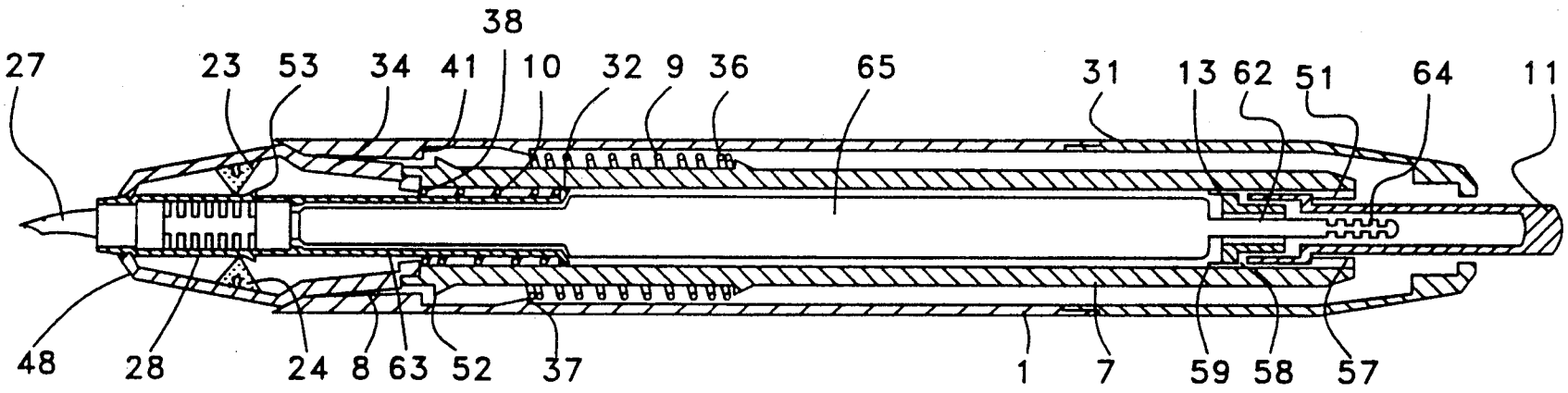
Figure 20:
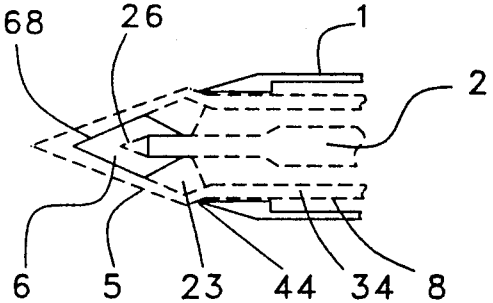
Figure 18:
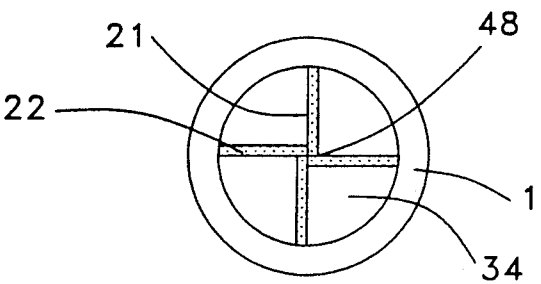
Figure 19:
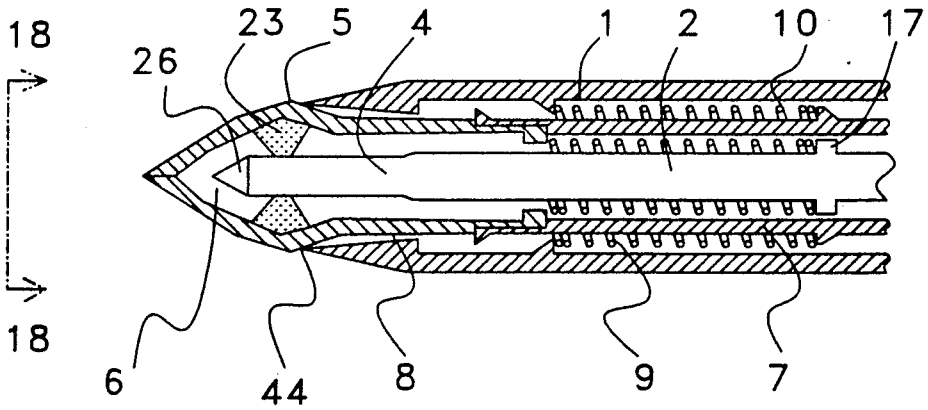
Figure 21:
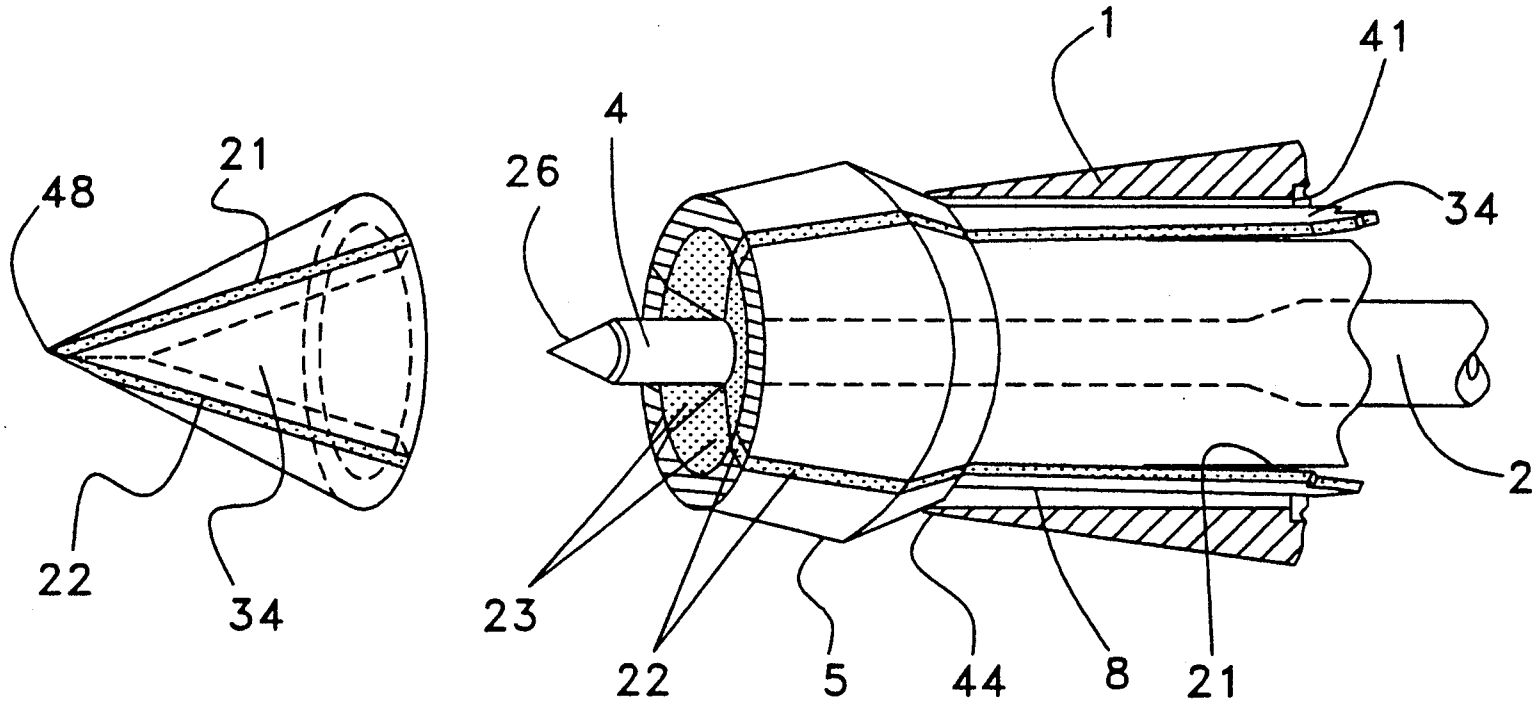
Figure 22:
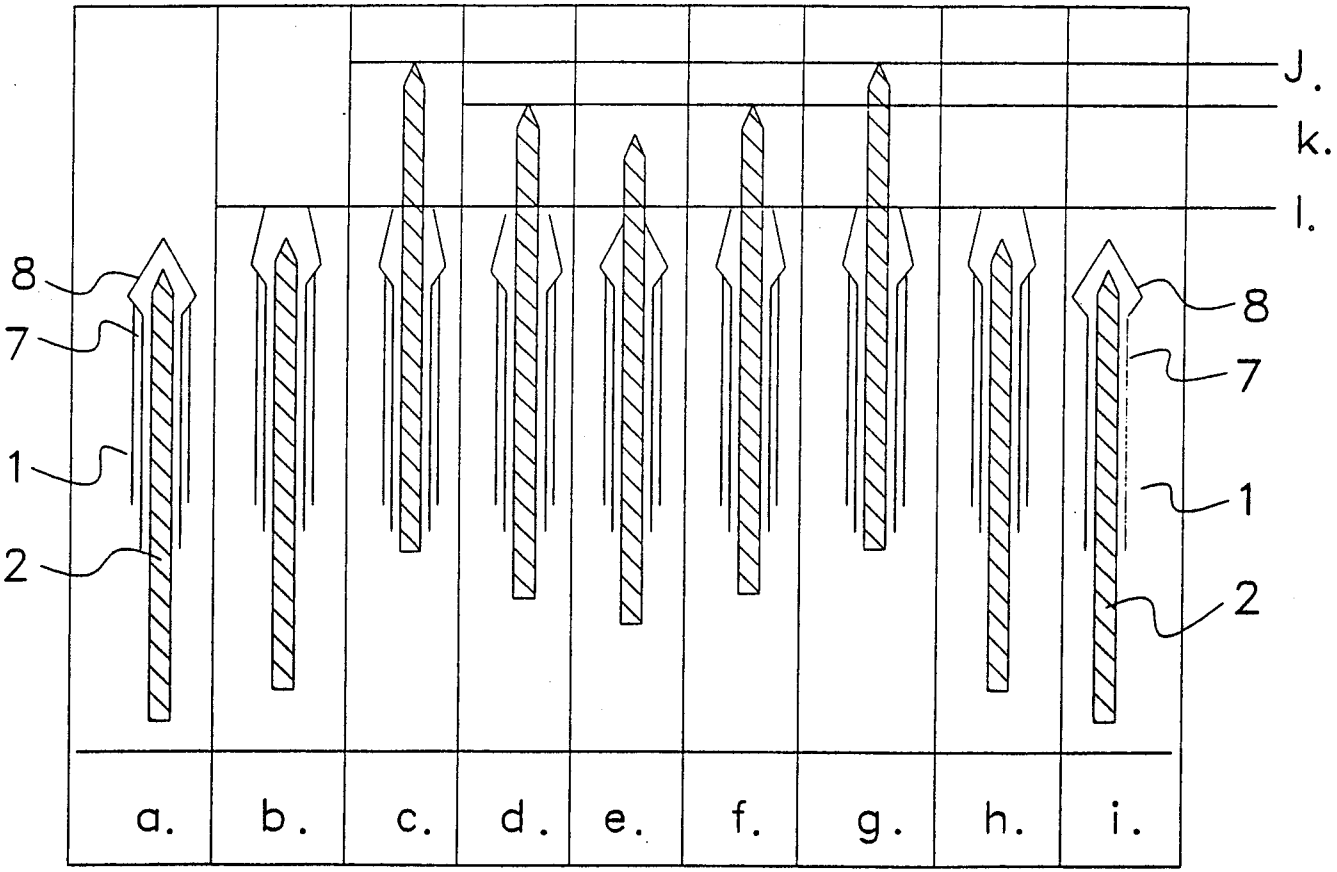
Figure 23:
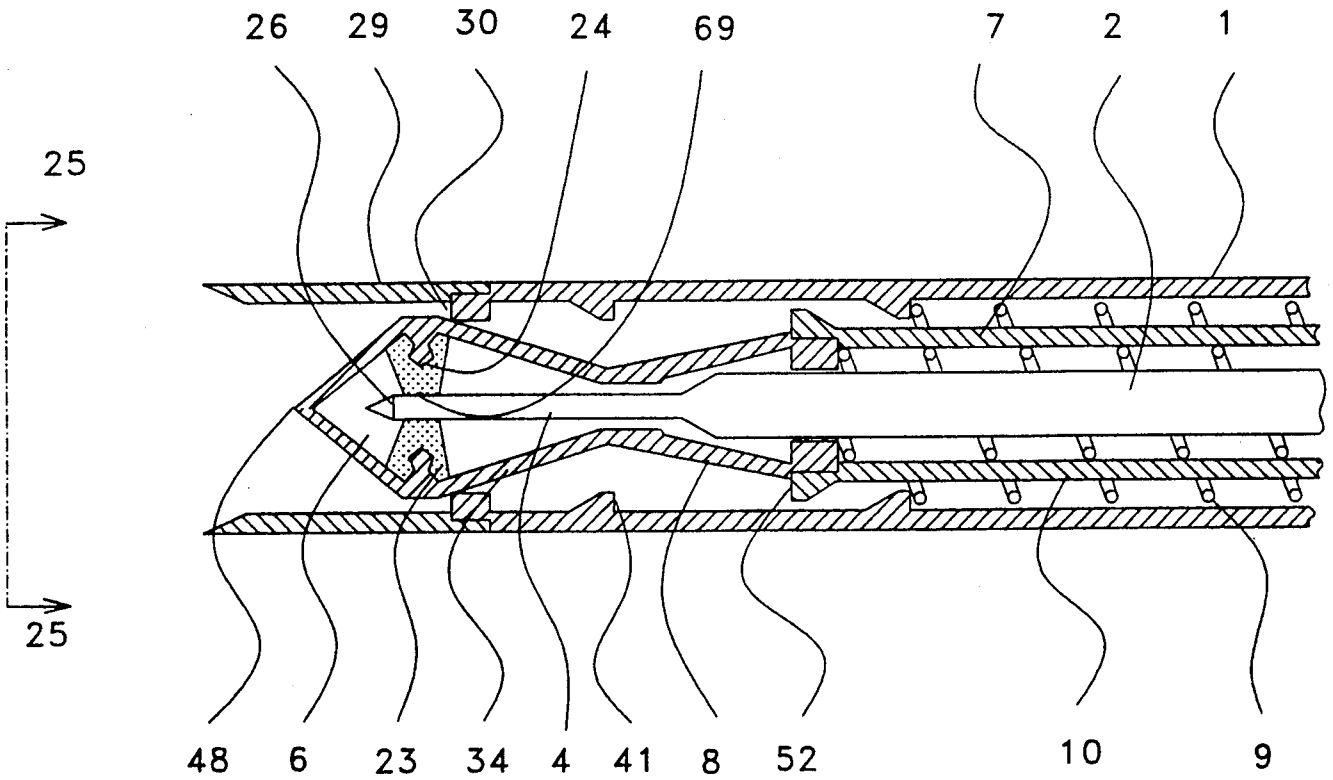
Figure 23A:
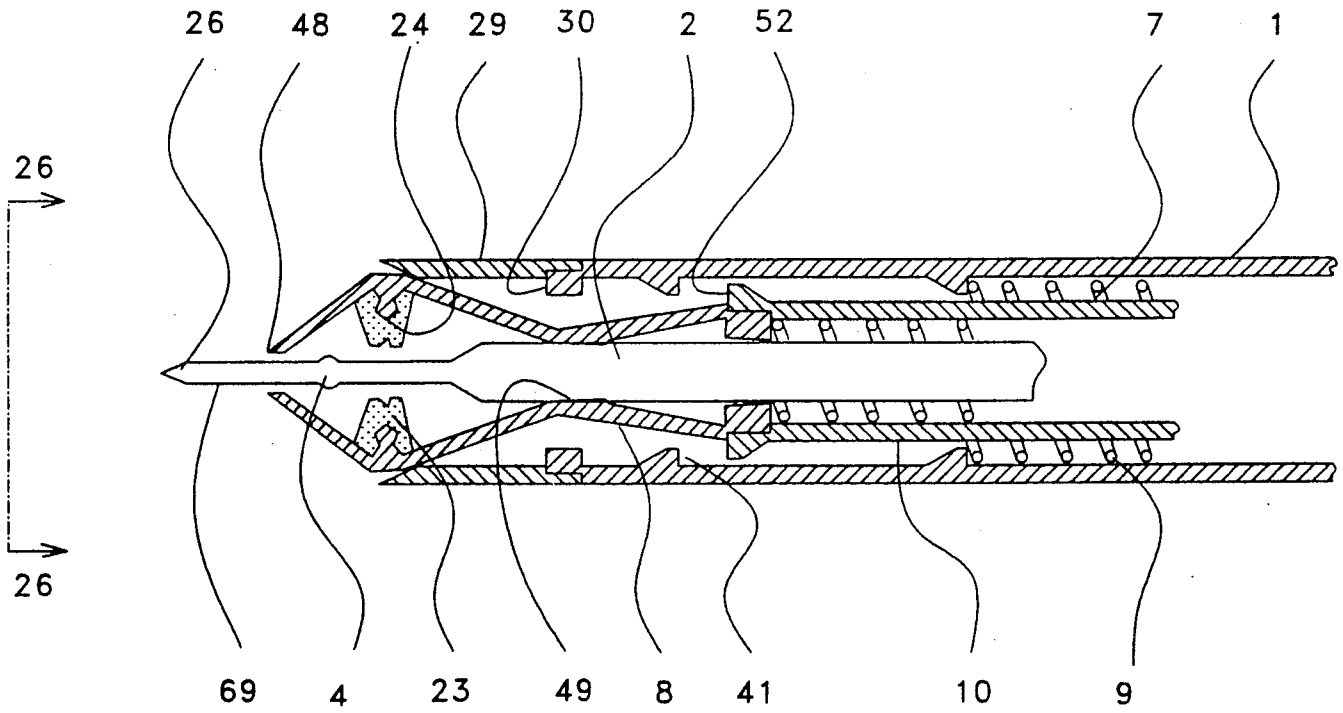
Figure 25:
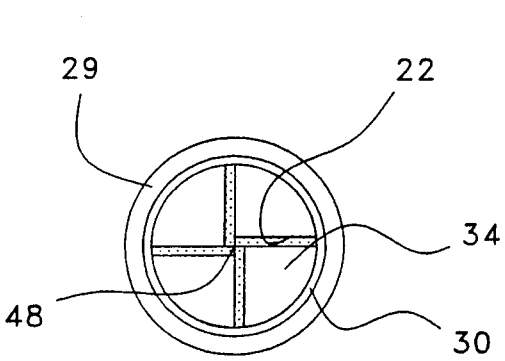
Figure 24:
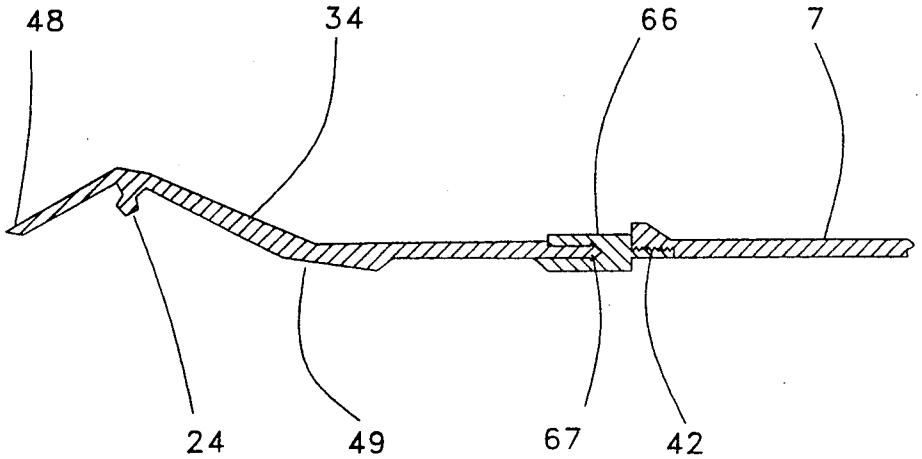
Figure 27:
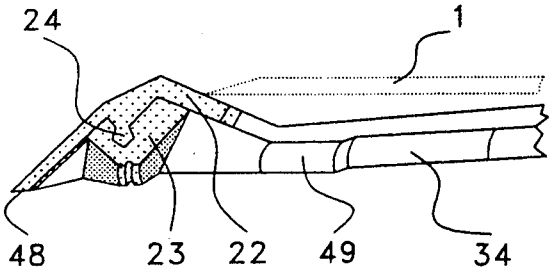
Figure 26:
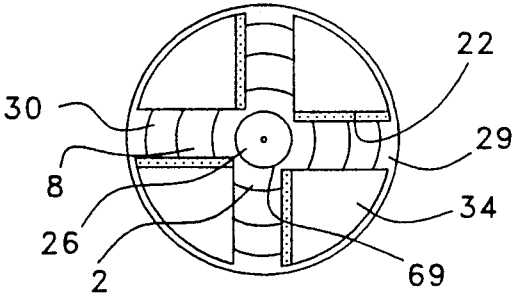
Figure 28:
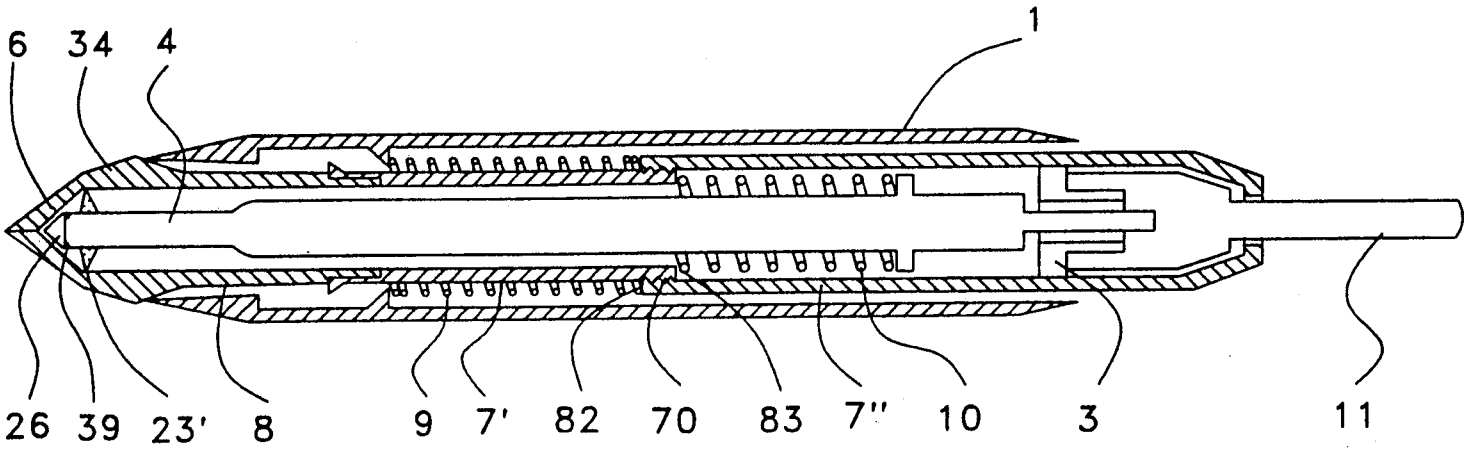
Figure 28A:
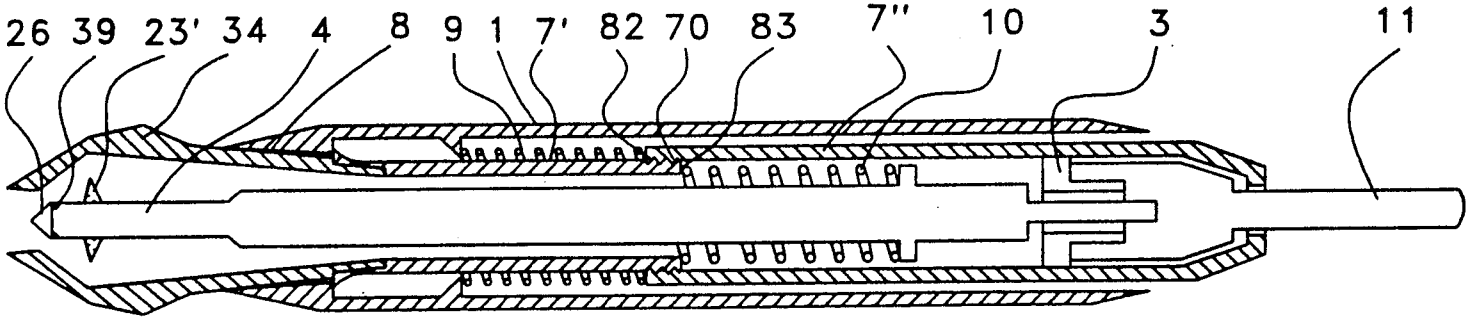
Figure 28B:
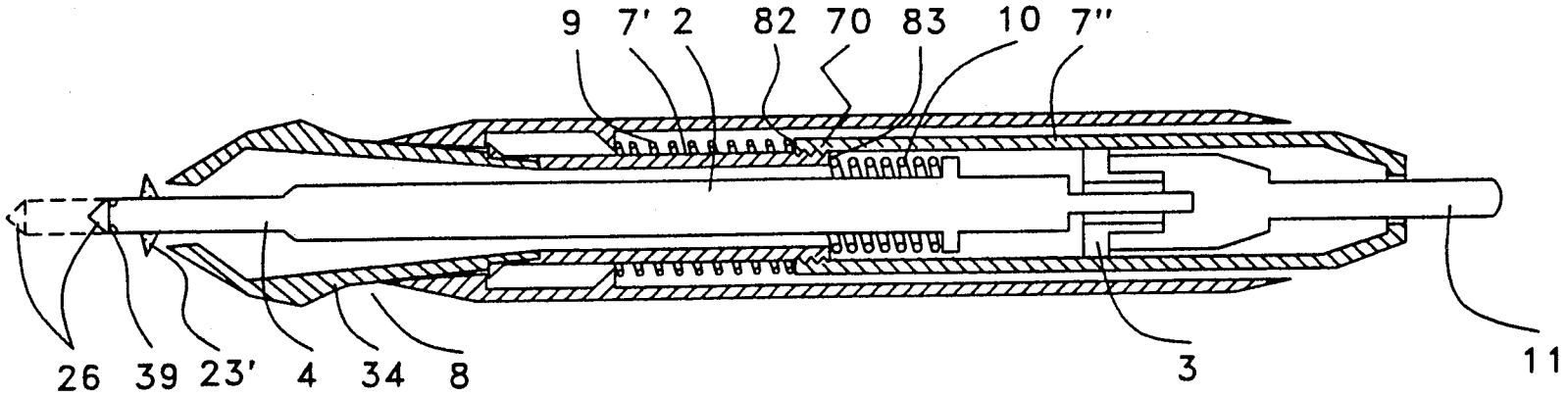
Figure 28C:
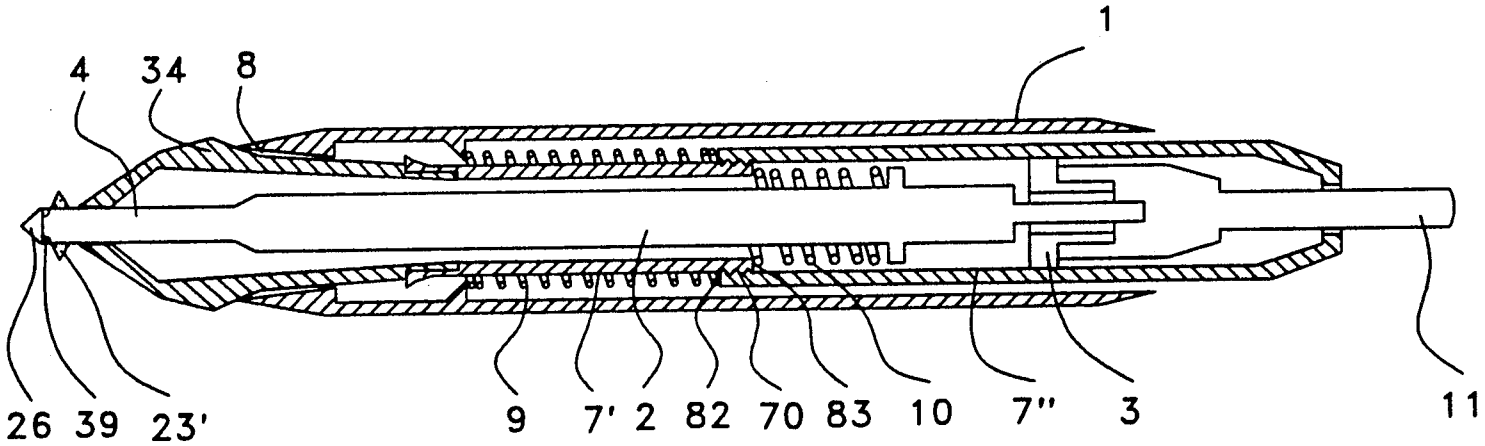
Figure 29:
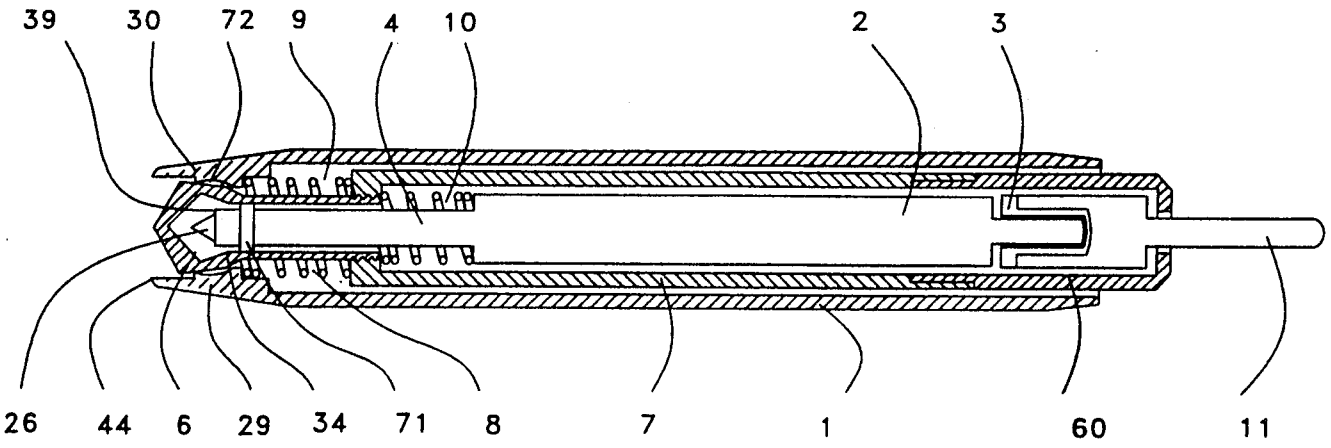
Figure 30:
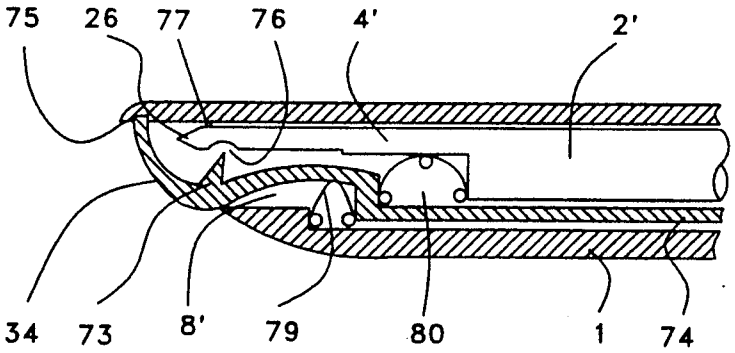
Figure 31:
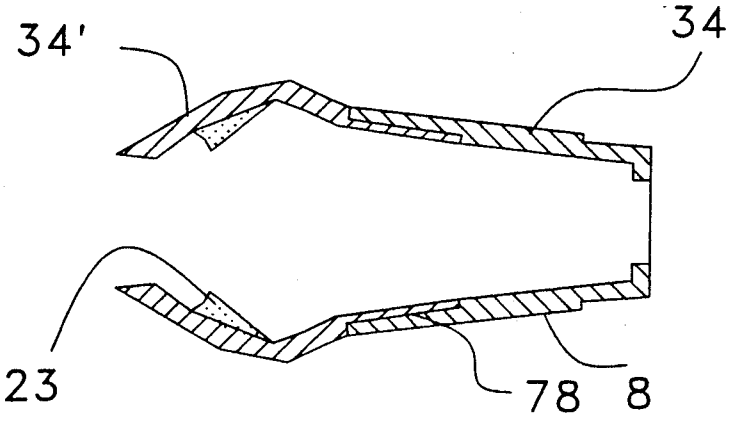
Figure 32A:
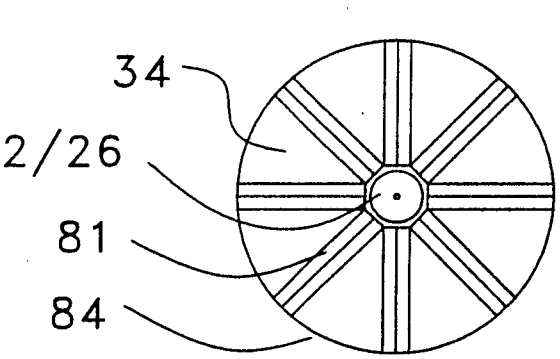
Figure 32:
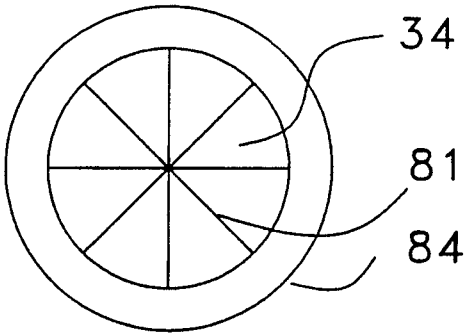
Figure 33:
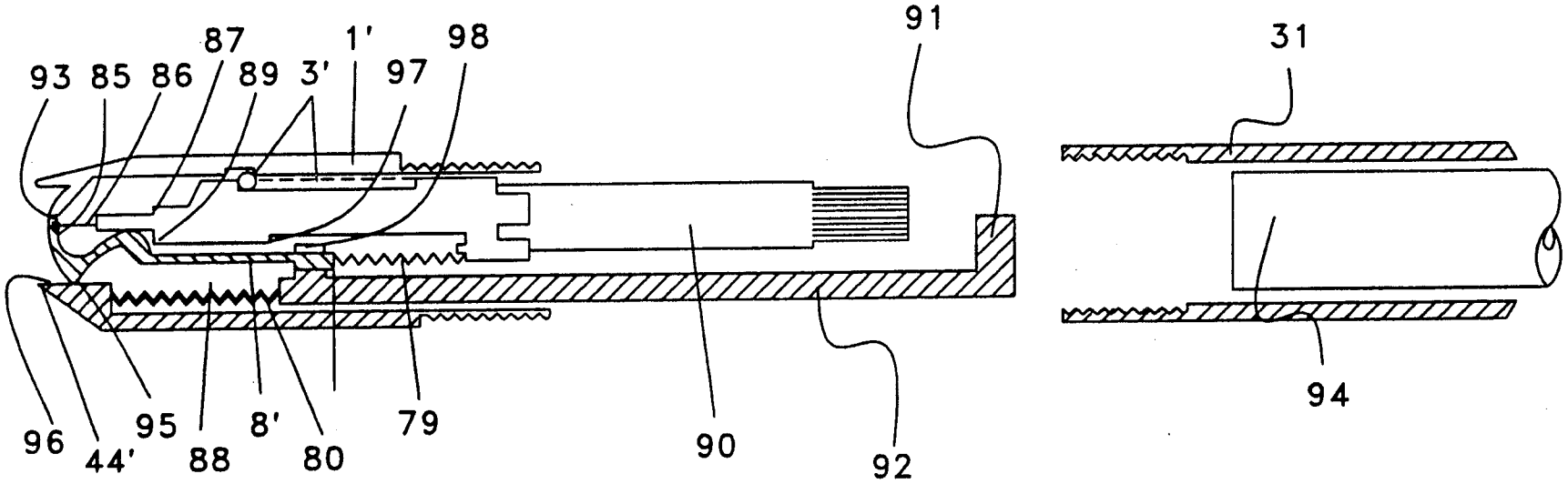

Hereinafter with the aid of the enclosed drawings 7 examples of embodiment of the writing implement will be described in detail. In the drawings:

FIG. 1 shows a longitudinal section through an embodiment of the writing implement in the closure or inoperative position, FIG. 1*a* is a longitudinal section through the writing implement of FIG. 1 in the writing position, FIG. 2 is a longitudinal section through a further embodiment of the writing implement in the closure position, FIG. 3 is a longitudinal section through a further embodiment of the writing implement in the closure position, FIG. 3*a* is a longitudinal section through the writing implement of FIG. 3 in the writing position, FIG. 4 is a cross-section through the writing implement according to FIG. 3*a*, FIG. 5 is a longitudinal section through the rear portion of the intermediate sleeve (7) according to FIG. 3, FIG. 6 is a partially broken-away longitudinal section through the front portion of the actuating element (and tensioning and shift element) (11) according to FIG. 3, FIG. 7–7*c* are longitudinal sections through a further embodiment of the writing implement in various rest, shift, etc., phases, FIG. 8 is a longitudinal section through a further embodiment of the writing implement in the rest position, FIG. 8*a* is a is a longitudinal section through the writing element of FIG. 8 in the writing position, FIG. 9 is a cross-section through the tip portion of the writing implement according to FIG. 8, FIG. 10 is a cross-section through the tip portion of the writing implement according to FIG. 8*a*, FIG. 11 is an unrolled inner view of the guide grooves (51) of the shift mechanism of FIG. 8, FIG. 12 is a front view of the nib or tip portion of the writing implement of FIG. 8, FIG. 13 is a front view of the tip portion of the writing implement of FIG. 8*a*, FIG. 14 is a longitudinal section through a further embodiment of the writing implement in the rest position, FIG. 14*a* is a longitudinal section through the writing implement of FIG. 14 in the writing position, FIG. 15*a*–*h* show details (and partial cross-sections) of various embodiments of the tip portion of the writing implement, FIG. 16 is a front view corresponding to FIGS. 15*d*, *f*, *g*, FIG. 17 is a front view according to FIGS. 15*e*, *h*, FIG. 18 is a front view according to FIGS. 15*a*, *b*, *c*, FIG. 19 is a partial cross-section through an embodiment to explain the hermetic chamber (segment chamber) in the tip of the implement, FIG. 20 is a schematic view of the sealing lines of the hermetic segment chamber corresponding to FIG. 19, FIG. 21 is a partially broken-away (and sectioned) perspective front view of the tip of the writing implement (with sectioned hermetic segment chamber) according to FIGS. 19 and 20, FIGS. 22*a–l* show an example of the movement sequences and shift movements of the examples of embodiment according to FIGS. 2, 7–7*c*, 8 and 8*a*, 14 and 14*a*, 23 and 23*a*, FIG. 23 is a partial longitudinal section through a further embodiment of the writing implement in the rest position, FIG. 23*a* is a partial longitudinal section through the writing implement of FIG. 23 in the writing position, FIG. 24 is a cross-section through parts of the closure means of a further embodiment of the writing implement, FIG. 25 is a front view of the tip portion of the writing implement of FIG. 23, FIG. 26 is a front view of the tip portion of the writing implement of FIG. 23*a*, FIG. 27 shows a partially broken-away individual bend-up segment (34) from the closure member or portion (8) of the writing implement of FIG. 23, FIGS. 28–28*c* are longitudinal sections through an embodiment of the writing implement in various rest, shift, etc., phases, FIG. 29 is a longitudinal section through a further embodiment of the writing implement, FIG. 30 is a partial longitudinal section through a further embodiment of the writing implement, FIG. 31 is a longitudinal section through the closure portion of a further embodiment of the writing implement, FIG. 32 is a front view of the closed tip portion of a further embodiment of the writing implement, FIG. 32*a* is a front view of the tip portion of FIG. 5 in the opened condition, FIG. 33 is a longitudinal section through a further embodiment of the writing implement.

The example of embodiment of the writing implement illustrated in FIG. 1 (or 1*a*) comprises a sleeve-shaped preferably two-part housing 1 and 31 and an intermediate sleeve 7 which is disposed therein and which at its end facing the nib is provided with a hermetically sealable closure portion 8 and at its rear end is provided with an actuating element 15, and finally a writing element 2 disposed in the writing implement and comprising a liquid writing agent which usually is liable to evaporate.

In the illustration of FIG. 1 the writing element 2 is for example a felt pen refill. The hermetically sealable closure portion 8 consists of 2 but preferably 3 to 10 radially outwardly biassed expandable bend-up segments 34 which consist of resilient or elastic material and which extend from the outside into the sleeve-shaped housing 1 and are there fixedly connected together at the end of the closure portion 8 facing the tip.

Via a screw, bayonet or the like connection 42 the closure member or portion 8 is mounted on the intermediate sleeve 7. The latter is in turn biassed by means of a radial projection 36 via a pressure spring 9 bearing against a shoulder 37 of the housing 1 in the direction opposite to the nib, the engaging closure portion 8 disposed partially outside thereby being pulled in the direction of the housing interior.

Since the tip portion 5 of the closure portion 8 projecting out of the housing 1 with respect to the internal diameter of the housing opening 44 has a greater external diameter which tapers in the direction of the housing interior to a smaller external diameter, the individual bend-up segments 34 at this bevelled portion of the housing opening 44 are radially inwardly compressed simultaneously to the same extent and by the same amount against their bend-up prestressing. The axial pressure acting through the pressure spring 9 on the intermediate sleeve 7 or on the closure portion 8 and deflected radially inwardly by means of the action of the housing opening 44 on the closure portion 8 must be greater than the sum of the radially outwardly acting bend-up pressure of all the bend-up segments 34 of the closure portion 8. As a result the bend-up segments 34 of the closure portion 8 combine to form a jointless segment cap hermetically sealing from the outside the tip 26 of the writing element 2 used for the writing, as shown in more detail in further illustrations (e.g. FIG. 21, FIG. 12, FIG. 9), which in turn to promote the gas sealing may be provided with a sealing element, for example a lateral elastic sealing material coating 22 (in FIG. 21).

Furthermore, the axially compressed bend-up segments 34 are connected to likewise jointless mutually engaging sealing bead segments 23 which behind the tip 26 of the writing element 2 bear sealingly on a tip portion 4 of the writing element 2 and thus seal in gas-tight manner the writing element tip 26 liable to dry out also with respect to the interior of the housing 1 or intermediate sleeve 7.

With the two sealing functions of the bend-up segments 34 and the sealing bead segments 23 connected thereto forwardly/outwardly as well as rearwardly/inwardly in the closure position illustrated of the writing element 2 a sealing chamber 6 results which is hermetically sealed on all sides and surrounds the writing element tip 26 liable to dry out (as can be seen still more clearly in FIGS. 20 and 21), and any air supply slits 39 for instance at the tip portion 4 of the writing element 2 can be accommodated within the hermetic sealing chamber 6 of the writing implement.

The modes of operation of the closure portion 8 producing the hermetic sealed chamber 6 or the bend-up segments 34 and the sealing bead segments 23 connected thereto, as well as the intermediate sleeve 7, may be considered basically the same for all embodiments of the writing implement in this respect, i.e. solely as regards establishing the gas-tight closure position of the writing implement, irrespective of other possible functions. The sealing bead segments 23 in the present embodiment (FIG. 1) also have in the closure position the function of securing the writing element 2 from wobbling or slipping within the writing implement and thus avoiding damage to the writing element tip 26.

To start operation of the writing implement the actuating element 15 connected to the intermediate sleeve 7 is depressed and the writing implement held with the tip downwards. Due to the resulting removal of the pressure of the housing opening 44 on the tip portion 5 of the closure member 8 the bendup segments 34 expand in the direction of their radial biassing until the sealing bead segments 23 connected thereto are adequately far enough apart radially to enable the writing element 2, which in turn is engaged in the function sleeve 43 associated with the writing element to drop out under the action of its own weight (and that of the function sleeve 43) from the implement sleeve 1 in the direction of the writing element tip 26, the dropping out of the writing element 2 being limited by a stop 16 of the function sleeve 43 impinging on a radial projection of the segment portion 38. The writing element 2 thereby projects far enough from the housing 1 and 31 through the intermediate sleeve 7 to expose the writing element tip 26 previously sealed in the hermetic sealing chamber 6 as well as any air supply slots 39 ensuring the writing agent flow at the tip portion 4 of the writing element 2 so that the writing operation can be carried out.

After termination of the depression of the actuating element 15 and the emergence of the writing element tip 26 the function elements of the writing implement move into the position indicated by FIG. 1*a*. Because the actuating pressure is removed, the pressure of the spring 9 again becomes effective via the intermediate sleeve 7, as does the radially inwardly directed deflection by the housing opening 44 onto the tip portion 5 of the closure portion 8. As a result, the bendup segments 34 are again pressed radially inwardly, the greater part of the radial pressure now acting via the pressure shoulder 49 on the function sleeve 43, which is due to the bend-up segments 34 and the writing element 2 being shaped with respect to each other in such a manner that the portion of the writing element 2 which after its limited emergence comes to lie directly parallel to the pressure shoulders 49 of the bend-up segments 34 having together with the function sleeve 43 a greater external diameter than the internal diameter of the closure portion 8 in the region of the pressure shoulders 49 whereas relatively thereto the portion of the writing element 2 lying directly in the region of the pressure shoulders 49 have a smaller diameter before the emergence thereof.

A smaller proportion of the radial pressure can also act via the segment tips 48 on the tip portion 4 of the writing element.

The axial writing pressure acting in the longitudinal direction of the writing implement against the writing element tip 26 is taken up by a function sleeve projection 47 against a lateral engagement surface 45 of the pressure shoulder 49 of the bend-up segment 34 and as a result a longitudinal side yielding or wobbling of the writing element 2 during writing is prevented whilst the laterally acting portion of the writing pressure is stabilized by the radial pressure of the pressure shoulder 49 on the function sleeve 43 and by the close guiding of the end of the writing element 2 in the actuating element 15 and the lateral guiding of the function sleeve 43 with respect to the projection 38 and of the stop 16 with respect to the intermediate sleeve 7.

The intermediate sleeve 7 is in turn closely guided in the rear portion of the housing 31 and can also be further radially stabilized therein with a resilient element.

Finally, to return the writing implement to the closure position again the actuating element must be correspondingly depressed again and the tip of the writing implement when this is done points upwardly, the dropping under gravity of the writing element 2 into the writing implement preferably being intercepted by the actuating element 15.

Should it become necessary to replace the writing element 2 one possibility a) is to remove the actuating element 15 and the rear portion of the housing 31 and then pull the writing element 2 by the portion now projecting rearwardly out of the intermediate sleeve 7 rearwardly until the function sleeve projection 47 strikes the radial projection 38 of the closure portion 8 (said projection being however integrated in the closure portion 8) and then to pull the writing element 2 against the resistance of the radial detent projection 54 out of the function sleeve 43. The tip portion 4 of the writing element 2 is so formed that during the withdrawal no writing agent is transferred from the writing element tip or nib 26 to the sealing bead segments 23, which can possibly also be prevented by slight depression of the intermediate sleeve 7 and corresponding radial expansion of the sealing bead segments 23.

Another possibility b) of changing the writing element is obtained by removing the closure member or portion 8 (e.g. screwing off) and then withdrawing it together with the writing element 2 from the sleeve 1/31 and the intermediate sleeve 7, whereafter the bend-up segments 34 and the sealing bead segments 23 are already radially spaced apart and the refill 2 can be withdrawn in the manner described above from the function sleeve 43 which is held fixed by the projection 47 and the projection 38 of the closure portion 8 in the latter.

A further possibility c) of changing the writing element is obtained in another example of embodiment which is not illustrated and in which the function sleeve 43 is a fixed part of the writing element 2, the radial projection 47 being so formed that on withdrawal of the writing element 2 from the closure portion 8 it can readily pass the projection 38 of said closure portion 8. In this example of embodiment after removal of the actuating element 15 and the rear housing 31 it is only necessary to hold the writing implement upwardly and displace the intermediate sleeve 7 briefly against the pressure of the spring 9, whereupon the bend-up segments 34 and the sealing bead segments 23 move apart and the writing element 2 drops back under the action of gravity. Finally, this displacement of the intermediate sleeve 7 is unnecessary if the sealing bead segments 23 are so formed that although they bear sealingly on the tip portion of the writing element 2 they do not bear so firmly that they prevent an axial rearward sliding under gravity.

Finally, a further variation d) of the writing element change is obtained if the writing element 2 and the actuating element 15 are so formed with respect to each other that the writing element 2 extends into the actuating element 15 to such an extent that after removal of the actuating element 15 it already projects far enought out of the rear housing half 31 to offer adequate gripping area for rearward extraction of the writing element 2 without an additional removal of the rear housing half 31 being necessary.

The function cycle of the embodiment described in FIG. 2 will be described further below in conjunction with FIG. 14.

The further example of embodiment of the writing implement illustrated in FIGS. 3 to 6 comprises a preferably two-part housing 1 and 31 and an intermediate sleeve 7 which is provided at its end facing the nib with a hermetically sealable closure member 8 and which at its rear end is clamped in an actuating and shift element 11, and finally a writing element 2 disposed therein and comprising a liquid writing agent generally liable to evaporate.

In FIGS. 3 and 3*a* the writing element 2 is for example a felt pen refill. The modes of operation of the hermetic closure portion 8 and the bend-up segments 34 as well as the sealing bead segments 23, the spring 9 and the intermediate sleeve 7 of the writing implement are as regards the hermetic closing of the writing element tip 26 in the sealing chamber 6 and only with respect thereto substantially analogous to the modes of operation of the corresponding elements of the example of embodiment according to FIG. 1/1*a*. The specific differences of the present example of embodiment compared with the example of embodiment illustrated in FIG. 1/1*a* result from the further functions when the writing implement is taken into operation. For this purpose the rear portion of the housing 31 (FIGS. 3, 3*a* and 4) is provided at its inner wall with guide grooves 51 for a shift mechanism 3 which is only schematically illustrated.

Furthermore, as apparent from FIGS. 4 and 5 the rear portion of the intermediate sleeve 7 is provided with preferably three longitudinally extending recesses 12 which extend up to the end of the intermediate sleeve 7 and thus divide the rear portion of the intermediate sleeve 7 accordingly into three equisized rigid lamellae 40. Said intermediate sleeve lamellae 40 are fixed as shown in FIGS. 3, 3*a* and 6 in corresponding clamping recesses 55 of the actuating element 11. The clamping effect can be further stabilized by matching flutes, grooves, etc. on the intermediate sleeve lamellae 40 and in the clamping recesses 55.

As apparent from FIGS. 3, 3*a* and 4 at the end portion of the writing element 2 remote from the nib 26 a preferably three-part control extension 14 is disposed which extends through the rear recesses 12 of the intermediate sleeve 7 in such a manner that the longitudinal displaceability of the writing element 2 is retained to a limited extent. The writing element 2 is biassed by means of the control extension 14 by an only weakly acting further spring 10 disposed between the writing element 2 and the intermediate sleeve 7 against a further preferably inside radial projection 46 against the intermediate sleeve 7. This only slight pressure of the spring 10 urging the writing element 2 against the intermediate sleeve 7 is passed on via the ends of the control extension 14 lying outside the intermediate sleeve 7 to a shift ring 13 (belonging to the shift mechanism 3, 13, 50 and 51) (FIG. 4) and to the shift teeth 50 of the actuating element 11 (FIG. 3) whilst the sealing bead segments 23 fixing the writing element can also take up part of this pressure as long as the closure state of the writing implement illustrated in FIG. 3 is maintained. The pressure of the spring 10 (FIG. 3) is thus as it were enclosed between the projection 46 of the intermediate sleeve 7 and the shift teeth 50 of the actuating element 11 connected to the intermediate sleeve 7 in said sleeve 7.

The writing element is taken into operation in a manner similar to a ballpoint pen by simply pressing once the actuating element 11. When this is done, via the actuating element 11 (FIG. 3) the intermediate sleeve 7 anchored therein is moved against the pressure of the spring 9, the bend-up segments 34 of the closure portion 8 connected thereto thereby expanding radially outwardly, and also parallel thereto the writing element 2, on which the slight thrust pressure required is exerted by the shift teeth 50 of the actuating element 11 via the shift ring 13 on the control extension 14 of the writing element 2.

To assume the writing readiness position illustrated in FIG. 3*a* the actuating element 11 is now pressed into the housing portion 31 until the shift ring 13 reaches the level of the changeover point 59 of the shift guide grooves and by means of the shift teeth 50 of the actuating element 11 jumps over into the grooves which extend only up to the detent position "outer" 58.

Due to the now declining actuating pressure the intermediate sleeve 7 and the writing element 2 supported against said sleeve 7 via the spring 10 are again pressed in the direction of the rear housing portion. In this rearward movement from the point of the detent position "outer" 58 the writing element 2 is engaged in the shift ring 13 (FIG. 4) supported against the housing whilst the intermediate sleeve 7 under the pressure of the spring 9 moves further rearwardly and finally the radially expanded bend-up segments 34 of the closure portion 8 withdraw behind the tip 26 of the supported writing element 2 to such an extent that said tip is freed for the writing operation. The intermediate sleeve 7 thereby moves rearwardly until the bend-up segments 34 are again pressed radially inwardly by the housing opening 44 at their bevelling tapering towards the housing interior.

The writing element 2 and the bend-up segments 34 are shaped with respect to each other in such a manner that the writing element 2 comprises with respect to its tip portion 4 a greater external diameter and in the writing readiness position the portion with the greater external diameter moves forwardly to such an extent that only the pressure shoulders 49 of the bend-up segments 34 press on the writing element 2 so that the segment tips 48 are not in engagement in order to prevent any sealing materials not illustrated here but possibly provided on the bend-up segments 34 (cf. for example FIGS. 12, 13, 16, 18) from being subjected to any bearing pressure which might damage them. A further axial displacement of the intermediate sleeve 7 in the direction of the actuating element 11 is prevented by the clamping action of the bend-up segments 34 between the writing element 2 and housing opening 44.

The pressure exerted by the further spring 10, supported at the projection 46 of the intermediate sleeve 7, on the control extension 14 of the writing element 2 is no longer taken up in this position by the shift teeth 50 of the actuating element 11 and thus within the intermediate sleeve 7 itself but via the shift ring 13 by the rear housing portion 31. As a result, the slight pressure of the spring 10 in the writing readiness position acts against the spring 9 and for this reason the pressure of the spring 9 must be greater than the sum of the pressure of the spring 10 and the bend-up pressure of all the bend-up segments 34 against the housing opening 44. The latter additional loading of the spring 9 by the spring 10 is dispensed with in another example of embodiment (not illustrated) in which the biassing of the control extension 14 of the writing element 2 is effected via a pressure spring 10 which lies outside the intermediate sleeve 7, acts on the ends of the control extension 14 likewise disposed outside and bears against the housing 1 or 31.

In this position the writing element is supported against the shift ring 13 and the rear housing portion against the the writing element tip 26 (FIG. 3*a*) whilst the fixing with respect to the laterally acting component of the writing pressure is ensured via the radial projection 38 at the closure portion 8, the projection 46 at the intermediate sleeve 7 and the radial pressure of the pressure shoulders 49 of the bend-up segments 34.

To return to the closure state only a further depressing of the actuating element is necessary, the corresponding functions taking place in corresponding order until the closure position in FIG. 3 is reached.

To permit the writing element change firstly the housing portion 31 is removed (FIG. 3). The guide grooves 51 of the shift mechanism 3 have no stops towards the housing end portion 31 so that the shift, clamping and actuating element guided therein can be withdrawn rearwardly from the intermediate sleeve lamellae 40 and removed from the guide grooves 51. By a slight depressing of the intermediate sleeve 7 the sealing bead segments 23 are now slightly lifted out of the sealing grooves 56 at the tip portion 4 of the writing element 2, whereupon the writing element 2 subjected to the slight pretensioning of the spring 10 together with the shift ring 13 disposed therebehind jumps slightly out of the writing implement and finally can be replaced.

All the further following examples of embodiment of the writing implement according to FIGS. 7, 8, 14, 2 and 23 have an automatic control mechanism functioning in accordance with the movement cycle illustrated in FIG. 22 for the purpose of matching the functions required for the preparation for writing or closing, such as holding, supporting, opening and closure functions of the closure portion 8 on the one hand, and functions of the emerging, engaging or disengaging, supporting or withdrawal of the writing element 2 on the other. Consequently, said examples of embodiment can be considered identical as regards the function of starting use thereof or closing them and for this reason following the explanation of the next example of embodiment in FIGS. 7 to *7c* the specific differences of the then following examples of embodiment will be dealt with.

The further example of embodiment of the writing implement illustrated in FIGS. *7–7c* comprises a preferably two-part housing 1 and 31 and disposed therein a likewise two-part intermediate sleeve 7 and 60 which at its end facing the nib is connected to a hermetically closable closure member 8; furthermore, the writing implement contains a writing element 2 which during the closure state (FIG. 7) is disposed substantially within the intermediate sleeve 7 (or 60) of the closure portion 8.

The writing element 2 is provided at its rear end with an actuating element 11 extending outwardly through both sleeves and a shift mechanism 3 (=13, 50 and 51) and guided there axially by a guide pin 35 in a shift ring 13 and in the actuating element 11. In the writing element 2 there is usually a liquid writing agent liable to evaporate and the tip 26 of the writing element 2 in danger of becoming dried out is hermetically sealed by the cooperation of the intermediate sleeve 7, the spring 9, the housing 1, the closure portion 8 and the sealing bead segments 23 and the housing opening 44 in the same manner as already explained for the corresponding parts in the first embodiment of the writing implement according to FIG. 1 and applicable to all the examples of embodiment of the writing implement.

To start operation of the writing implement by a pressure actuation which has to be effected only once firstly the closure portion 8 must be opened without the writing element 2 moving with respect thereto because a premature advance could damage the nib 26 and secondly the writing element must be brought via a shift mechanism disposed in the writing implement into the writing readiness position. For this purpose, the closure member 8 continuously subjected to closure (pre) tensioning must be held open until the advance, shift and engagement operation with which the writing element 2 is brought into the writing readiness position is concluded and the writing implement is equipped with the control mechanism necessary for this. This includes disposed in intermediate sleeve 7, which is biassed via a spring 9 against the housing 1, a further spring 10 via which the writing element 2 is biassed by means of a radial projection 17 against a radial projection 38 of the intermediate sleeve (which however for the purpose of refill change is integrated in the closure portion 8 (FIG. 7). The spring 10 exerts a stronger pressure force than the spring 9 so that the writing element 2 is biassed more greatly against the intermediate sleeve 7/60 in the direction of the actuating element 11 than the intermediate sleeve 7/60 against the housing 1 (likewise in the direction of the actuating element 11) whilst on the other hand the biassing pressure on the writing element 2 is taken up by the actuating element 11 against the intermediate sleeve portion 60 and the intermediate sleeve biassing by the closure portion 8 against the housing opening 44.

The intermediate sleeve 7 further comprises a limit projection 52 by which its axial displaceability is restricted to the relatively small distance between the limit projection 52 and a further housing shoulder 41. Furthermore, on the inner wall of the rear intermediate sleeve portion 60 guide grooves 51 are provided for a shift mechanism 3 which also includes the shift ring 13 and the shift teeth 50 of the actuating element 11. (Instead of the detent mechanism 3 or 51, 50 and 13 illustrated other appropriately suitable detent mechanisms may be used.)

To start operation of the writing implement the actuating element 11 is depressed. For the movement sequences which are then started reference is also made to the "model of the function sequences and thrust movements" in FIG. *22a–l*.

By the actuating pressure arising and exerted by the actuating element 11 via the shift teeth 50 thereof on the shift ring 13 and finally on the writing element 2, first both the writing element 2 moves and also parallel thereto the intermediate sleeve 7/60 axially in the direction of the housing opening 44 (FIG. 7 following FIG. *7a*). Initially the writing element 2 does not move relatively to the intermediate sleeve 7/60 because the pressure exerted by the writing element 2 via the strong spring 10 on the intermediate sleeve 7 is passed on almost completely to the weaker spring 9 at which the intermediate sleeve 7 is in turn supported with respect to the housing 1. During this operation, which continues until the limit projection 52 of the intermediate sleeve 7 meets the housing shoulder 41 (FIG. *7a*), only the closure portion 8 opens, i.e. the bend-up segments 34 and the sealing bead segments 23 connected thereto spread apart radially to such an extent that the writing element 2 or its tip portion 4 can pass unrestricted outwardly (cf. also FIGS. *22a* to *b*).

In the stage of starting operation of the writing implement shown in FIG. *7a* by the advancing limitation of the intermediate sleeve 7/60 (and of the closure portion 8) further compression of the spring 9 by the spring 10 is prevented, whereupon finally the writing element 2 moves axially forwardly against the pressure of the spring 10 relatively to the intermediate sleeve 7/60. As this happens firstly the shift ring 13 disposed in the rear intermediate sleeve portion 60 and belonging to the shift mechanism 3 moves up to a changeover point 59 and secondly the tip portion 4 of the writing element 2 moves through the open tip portion 5 of the closure portion 8 until the tip 26 of the writing element 2 assumes the position which is shown only in dashed line in FIG. 7*b* and which corresponds in FIG. 22 to position c.

When the actuating pressure now declines the writing element 2 moves under the spring pressure of the spring 10 again in the direction of the actuating element 11 until the shift ring 13 is engaged in the detent position "outer" 58 and thus terminates the rearward movement of the writing element 2 and supports the latter (FIG. 7*b* and FIG. 22*d*). During this rearward movement of the writing element 2 as well the closure portion 8 remains permanently opened because the pressure transfer of the spring 10 to the spring 9 is maintained. Only when the pressure of the spring 10 is supported by the shift ring 13 in the detent position "outer" 58 of the shift guide grooves 51 and the actuating pressure declines still further does the intermediate sleeve 7/60 move under the pressure of the spring 9 jointly with the writing element 2 in the direction of the actuating element 11 until by the radial pressure of the housing opening 44 the bend-up segments 34 come to bear on the segment tips 48 on the tip portion 4 of the writing element 2 (FIG. 7*c* and 22*e*).

The example of embodiment of the writing implement according to FIGS. 7 to 7*c* is thus brought by a single pressure actuation into the writing readiness position, passing through the phases illustrated in FIGS. 22*a–e*. The instant of the effective actuating pressure is represented here in phases FIGS. 22*a–c* and the declining or terminated actuating pressure in the phases FIGS. 22*c–e*. The maximum advance of the closure portion 8 (or the intermediate sleeve 7/60)is indicated by the line 1, the maximum advance of the writing element 2 up to the changeover point 59 of the shift mechanism 3 by the line j and the level of the engaged writing element 2 when the closure is opened by the line k.

The function cycle which occurs on further pressure actuation for reclosing is finally shown by the phases c-i in FIG. 22.

For the writing operation the writing element 2 (FIG. 7*c*) is supported with respect to the axially acting writing pressure by the shift ring 13. The radially acting writing pressure on the other hand is taken up via the guide pin 35 against the shift mechanism 3, the radial projection 17 and 38 against the intermediate sleeve and writing element 2, and by the inwardly directed radial pressure of the segment tips 48 of the bend-up segments 34. The writing element 2 and the bendup segments 34 may be shaped with respect to each other as in the example of embodiment of FIGS. 3 and 3*a* so that during writing the segment tips 48 are not in engagement but mainly specific segment shoulders 49.

To replace the writing element 2 either the closure portion 8 or the rear sleeve portions 31 and 60 can be removed.

A further example of embodiment of the writing implement according to FIGS. 8 to 13 comprises a preferably two-part housing 1 and 31 and a short intermediate sleeve 7 which is disposed in the front housing portion 1 and at the end thereof facing the nib a hermetically sealable closure portion 8 is mounted. In the writing implement there is also a writing element 2 which is axially guided via a guide pin 35 secured to its rear end in an actuating element 15 (without additional shift function).

The sequence of the functions and thrust movements which occur when this writing element is operated corresponds to the function sequence of FIG. 22 of the example of embodiment in FIG. 7–7*c*. Furthermore, the nature of the hermetic sealing of the writing element tip 26 corresponds to the type of closure with the previous examples of embodiment of the writing implement.

Specific features of the present embodiment of the writing implement (FIGS. 8–13) are in the arrangement and type of the shift mechanism 3, the writing element 2 and its biassing spring 10, the bend-up segments 34 and the simplified manner of changing the writing element. The shift mechanism 3 of the writing implement consists only of certain (shift) guide grooves 51 disposed at the inner wall of the short intermediate sleeve 7 (FIG. 11)and a special shiftable writing element 2 which is provided at its portion lying directly in the region of the intermediate sleeve 7 with preferably 3 or 4 shift guide members 61 (FIGS. 8, 8*a*).

The writing element 2 is supported against an end edge flange 18 of the intermediate sleeve 7 biassed by a spring 9 via a somewhat enlarged radial projection 17 with a stronger spring 10 disposed behind the intermediate sleeve 7. Since the guide groove 51 of the shift mechanism 3 (FIG. 11) for the shift guide members 61 (for clarity only one of four is shown) of the writing element 2 are axially displaceable in the direction of the actuating element 11 "open" and the spring 10 is supported via the writing element 2 and the actuating element 11 at the rear housing portion 31 (FIG. 8*a*), in this embodiment the biassing of the writing element 2 by the spring 10 in the closure state must be very small or almost zero ponds because otherwise the closure portion 8 would be permanently pressed against the pressure of the spring 9.

The shift guide members 61 (FIG. 11) made integrally with the writing element, due to their double end-side bevelling in conjunction with the correspondingly bevelled end sides of the webs of the shift mechanism 3 defining the guide grooves 51, on pressure actuation of the writing element 2 are able without any additional shifting element to carry out all the necessary shifting or switching functions. In FIG. 11 the position of only one shift guide member 61 (of four)is shown in the detent position "inner" 57 (corresponding to FIG. 8, FIG. 22*a*), at the changeover point 59 (corresponding to FIG. 22*c*) and in the detent position "outer" 58 (corresponding to FIG. 8*a*, FIG. 22*e*).

In the writing position (FIG. 8*a*) the high pressure of the spring 10 cannot become operative against the spring 9 because it is taken up by the shift member 61 of the writing element 2 in the detent position "outer" 58 within the intermediate sleeve 7, and the bend-up segments 34 or their segment tips 48 can thereby via the pressure of the spring 9 and the housing opening 44 effect the fixing of the tip portion 4 of the writing element 2 (FIG. 13). Instead of by segment tips 48 the fixing can expediently also be effected by pressure shoulders 49 of the bend-up segments 34 as illustrated for instance in the example of embodiment in FIG. 3*a*. FIG. 9 shows how with the preferably three bend-up segments 34 of the closure portion 8 the gas-tight seal of the segment edges can be further increased with a lateral elastic sealing material coating 22. Together with the sealing bead segments 23 bearing gapless on each other and on the tip portion behind the writing element tip 26 a hermetic area forms which with the tips 48 of the bend-up segments 34 (FIG. 12) bearing on each other in front of the writing element tip 26 establishes the complete hermetic sealing of the writing element tip 26.

The writing element 2 is changed by withdrawing it from the writing implement rearwardly against the slight resistance of the sealing bead segments 23 after removal of the rear housing portion 31. The writing element tip 26 is so constructed that during this operation no writing agent can reach the sealing bead segments 23, for example by having a somewhat smaller maximum external diameter than the tip portion 4 (as apparent in FIG. 13).

A further example of embodiment of the writing implement illustrated in FIGS. 14 and 14*a*, which is also taken into operation as shown by FIGS. 22*a–e* and out of operation in accordance with FIGS. 22*e–i*, is preferably a cartridge pen which can also be constructed for example as plunger pen or capillary pen.

The writing implement consists of a preferably two-part housing 1 and 31 and of a usually one-part intermediate sleeve 7 on the write-side end of which a hermetic closure portion 8 is mounted. In the front portion of the housing 1 or of the intermediate sleeve 7 and within the closure portion 8 (FIG. 14) there is furthermore a filler element 28 which usually remains in the writing implement and comprises a cartridge receiving sleeve 63 and a tip-side nib 27.

Furthermore, in the writing implement a special shift cartridge 65 fixedly located in the filler element 28 and cartridge receiving sleeve 63 is arranged and is provided with writing agent. The shift cartrdige 65 is held at its rear end via a guide 62 in a shift ring 13 and the shift and actuating element 11 and is so formed that it withstands the actuating pressure necessary for shifting purposes without deformation. To replace the shift cartridge 65 it is only necessary to detach the rear housing half 31 in the rest position of the writing implement (FIG. 14) from the front 1 and then withdraw the latter with the shift and actuating element supported thereon from the writing implement rearwardly, the guide grooves 51 of the shift mechanism 3 being made rearwardly "open". Thereupon the shift cartridge 65 can be withdrawn rearwardly by means of a grip 64 disposed on its guide 62 from its securing to the filler element 28, the shift ring 13 thereby also being withdrawn through the rearwardly open guide grooves 51 (which thus do not have a detent position "inner" 57 in the true sense but a "nonengaged inner position" 57). Since the biassing pressure of the spring 10 in the closure condition of the writing implement (FIG. 14) acts on the filler element 28 and thus via the shift cartridge 65 on the shift ring 13 and finally the actuating element 11 can act through the open guide grooves 51 against the housing portion 31, this biassing pressure must be taken up at the filler element 28 by a limit projection 53 to avoid the intermediate sleeve 7 or the closure portion 8 being held continuously open in the closure state.

The spring 10 and also the filler element 28 is axially supported during the writing condition (FIG. 14*a*) in the detent position "outer" 58 which permits radial supporting of the filler element 28 by the segment tips 48 of the bendup segments 34.

The sealing bead segments 23 are held in the writing implement via detent profile strips 24 at the bend-up segments 34 and engage during the closure condition (FIG. 14) into correspondingly formed sealing grooves 56 at the tip portion 4 of the filler element 28.

In another preferred embodiment of the writing implement, not however illustrated, the detent profile strips 24 are shaped so that in the closure condition of the writing implement in addition to the sealing bead segments 23 they also engage in the sealing grooves 56 or in other grooves worked additionally into the filler element 28 in order for example to reliably take up the pressure of a cartridge newly engaging in the fixed position (apart from the strong pressure spring 10) provided during this time the cartridge pressure is counteracted by external pressure applied to the closure portion 8. In addition, these detent profile strips 24 of the bend-up segments 34 anchored during the closure condition in the filler element 28 are so formed that on pressure actuation for starting operation of the writing implement they do not detach from their anchoring in the filler element 28 until the bend-up segments 34 due to their materially inherent radially outwardly directed biassing have bent up enough to release the anchoring and permit an unrestricted emergence of the filler element 28 and the nib 27. Apart from the spring 10 profile strips formed in this manner (which fundamentally can also be used in all other examples of embodiment) provide additional certainty that the filler element 28 and the usually expensive and sensitive nib 27 cannot prematurely shift (e.g. when the pressure actuation is effected extremely rapidly or the spring 10 fails) against the still closed closure portion 8 and thereby be damaged, and also that for example sealing bead segments 23 made from particularly soft elastic material under similar loads are not damaged by sealing grooves 56 slipping past or the like.

In a further example of embodiment of the writing implement according to FIG. 2 substantially identical to the example of embodiment of FIGS. 14/14*a* of the writing implement in the front housing portion 10 instead of a filler element 28 there is a tip portion sleeve 19 in which instead of a shift cartridge 65 a writing element 2 is guided whose tip 26 is enclosed in air-tight manner within the hermetic chamber 6 and whose tip portion 4 is additionally sealed with respect to the housing interior via a seal 23 disposed within the end of the tip portion sleeve 19.

The present writing implement as designed according to FIG. 2 provides compared with the example of FIG. 7–7*c* firstly the possibility of the simplest writing element change when using very simply designed writing elements (apart from the guide pin 35 provided with a grip). Since the sealing bead segments 23 do not engage directly on the writing element after removal of the rear housing portion 31 and of the actuating element 11 the writing element 2 can be pulled out by the grip of the guide pin 35 without further provisions being taken. Furthermore, in the production of such a writing implement it is possible to match the sealing bead segments 23 and the sealing grooves 56 at the front end of the tip portion sleeve 19 particularly exactly to each other because the sleeve remains in the writing implement and as a result the hermetic chamber 6 can possibly be sealed to an even greater extent.

In FIGS. 15 to 18 various examples of embodiment of the closure member 8 are shown. In FIGS. 15*a–h* cross-sections are shown through bend-up segments 34 of different embodiments of the closure portion 8 (with preferably four bend-up segments 34), different combinations of the profiling of the segment edges 21 and the use of sealing material coatings 22 being illustrated. When sealing material coatings 22 are provided on only one side the segment edge profiles can be formed according to FIGS. 15*a, b, c* and *e* and when they are provided on both sides substantially according to FIG. 15*d*, *f* and *g*, and without coating according to FIG. 15*h*.

FIG. 16 shows the front view of a closed closure member 8 supported on the housing 1 and having sealing material coatings 22 on both sides of the segment edges 21; FIG. 18 for example illustrates segment edges 21 provided with sealing material on one side (apart from in a segment edge profiling according to FIG. 15*e*). Without segment edge coating (for example in FIG. 15*e*) the closed closure portion usually appears as in FIG. 17.

In FIGS. 19 to 21 the closure elements of an embodiment of the writing element are shown in detail.

As partially illustrated in FIG. 19 the present closure portion 8 belongs to an embodiment of the writing implement which is also equipped with a control mechanism controlling the operation start or reclosing in accordance with the function cycle illustrated in FIG. 22. The closure portion 8 in this type of mechanism is biassed via a spring 9 weaker compared with the spring 10 of the writing element 2 (apart from the materially inherent radially outwardly directed biassing of its bend-up segments 34). If the total necessary actuating pressure which must also overcome the pressure of the stronger spring 10 is not to be too high, this involves a somewhat lesser radially inwardly directed closure pressure of the housing opening 44 against the bend-up segments 34. It is therefore advisable in embodiments of the writing implement having such a control mechanism to use inter alia a lateral sealing material coating 22 for the bend-up segments 34 as is apparent from a detailed illustration of a tip portion of the writing implement in FIG. 21. It is further clear from FIG. 21 in what manner (in this case preferably four) individual bend-up segments 34 bear on each other without gaps up to the segment tip 48 and together with their sealing bead segments 23 which also bear gapless on each other and at the same time on the tip portion 4 of the writing element 2 form the hermetic sealing chamber 6 about the writing element tip 26 liable to dry out. The writing element tip 26 is so shaped that it has a somewhat smaller maximum external diameter than the tip portion 4 of the writing element 2 (which of course with capillary pens is easiest to effect), thus enabling the writing element 2 to be withdrawn rearwardly for replacement without its tip 26 passing writing agent to the sealing bead segments 23 and without the closure portion 8 having to be held back by the pressure on the intermediate sleeve 7.

The sealing effective on all sides and produced by the individual bend-up segments 34 as illustrated in FIG. 21 is clearly apparent in particular from the sealing line 68 illustrated in FIG. 20 of the hermetic segment chamber 6 (in conjunction with the tip portion 4 of the writing element 2) about the writing element tip 26.

The elastic sealing material coating 22 shown in FIG. 21 and additionally sealing the segment edges 21 extends preferably only up to just before the region where the bend-up segments 34 in the closure state (FIG. 21) contact the housing opening 44 to avoid a sliding contact between the elastic material at the bend-up segments 34 and the housing opening 44 during an opening of the closure portion 8. This can however also be achieved by a segment edge profiling and a sealing material coating according to FIG. 15*e*.

In the FIG. 18 referred to above the circular front view of the closure portion 8 supported on the housing 1 of the present example of embodiment is illustrated.

In other examples of embodiment, not illustrated, of the writing implement the front view of the housing 1 or of the closed closure member 8 may also have other forms, such as straight-side or arcuate-side polygons and the like.

In a further example of embodiment, not illustrated, of the closure member 8 the sealing bead segments 23 are so formed that they bear both as for example in FIG. 19 behind the writing element 26 on the tip portion 4 and additionally in front of the tip 26 gapless on each other so that the sealing bead segments 23 on their own produce a hermetic chamber 6 about the writing element tip 26 and thus even with writing agents extremely liable to evaporate a lateral sealing material coating 22 for the bend-up segments 34 can be dispensed with.

In another likewise not illustrated example of embodiment of the closure member 8 which can be used with writing elements 2 with writing agents not very liable to evaporate the sealing bead segments 23 providing the sealing with respect to the housing interior can be omitted completely and the lateral sealing material coatings 22 of the segment edges 21 (preferably formed according to FIG. 15*e*) may be continued up to the rear end of the bend-up segments 34 or likewise omitted.

In a further example of embodiment of the writing implement, not illustrated, the form of the functionally identical closure portion 8 is without tip portion 5 or flat on the tip side. The bend-up segments 34 thus extend after the maximum external diameter of the closed closure portion 8 lying outside the housing opening 44 directly radially to the housing axis, the hermetic sealing chamber 6 and the writing element tip 26 disposed therein having to be disposed correspondingly lower within the housing 1. Such a configuration of the closure portion 8 has the advantage that the now flatly tapering segment tips 48 even under a strong frontal impact of the writing implement or other blow, etc., loads are relatively well protected.

In FIGS. 23, 23*a* and 25 to 27 a further preferred embodiment of the writing implement is illustrated which relates in particular to the configuration of the closure elements. Apart from the control mechanism illustrated in FIGS. 23 and 23*a* and operating according to FIG. 22 this closure configuration may be applied to all the embodiments of the writing implement. As particular features the present writing implement first has a housing extension 29 which can be secured by means of a bayonet, screw, plug, etc., connection to the nib-side end of the housing portion 1. With this housing extension it is possible to protect from impact, shocks and other effects also the tip region 5 of the closure member 8 generally forming the hermetic segment chamber 6 and in particular the (possibly impact-sensitive) segment tips 48. Thus, due to the housing extension 29 firstly the hermetic segment chamber which is formed by the bend-up segments 34 is retracted and protected (FIG. 23 and 25) during the closure state. Secondly, the bend-up segments 34 are supported in this case in the closure state (FIGS. 23 and 25) on a clamping shoulder 30 and in the writing readiness state (FIGS. 23*a* and 26) by the opening of the housing extension 29.

Furthermore, the bend-up segments 34 of the writing implement (FIGS. 25, 26, 27) coated with a sealing material 22 are so shaped that the segment tips 48 formed from sealing material 22 in the writing readiness state (FIG. 26) do not bear on the tip portion 4 but instead pressure shoulders 49 worked into the bend-up segments and as a result a permanent or brief deformation of the resilient segment tips 48 possibly caused by the bearing pressure is avoided. The tip portion 4 of the writing element 2 is also provided with a radial sealing projection 69 which in the storage state (FIG. 23) engages in corresponding depressions in the sealing bead segments 23 (FIG. 27).

In FIG. 24 a last example of embodiment of a bend-up segment 34 is illustrated which is disposed in a bent-up state due solely to the material and not influenced by springs, housing openings, etc. In this embodiment the bend-up segment 34 is individually worked and is held and firmly clamped in an intermediate ring 66 by means of a detent projection 67. This embodiment makes it possible to facilitate certain operations which might be necessary in the production of bend-up segments 34 of a corresponding closure portion 8, such as working the detent profile strips 24 of the pressure shoulders 49 etc. or securing the sealing bead segments 23, since a single bend-up segment 34 is more directly accessible for such work.

The example of embodiment of the writing implement illustrated in FIGS. 28–28c comprising a preferably one-part sleeve-shaped housing 1 and disposed therein a preferably two-part intermediate sleeve 7' and 7" whose front portion 7' at its end facing the nib is connected to a hermetically sealable closure portion 8 and at its rear end via a screw or the like connection 70 to the rear intermediate sleeve portion 7" which has a greater diameter than 7'. In other embodiments the closure portion 8 may also be integrally connected to the front intermediate sleeve portion 7', the resulting combined part consisting for example of two half shells welded together. Furthermore, it is also possible to provide the front intermediate sleeve portion 7' with the greater diameter and the rear portion 7" with the smaller diameter and to locate the springs 9 and 10 correspondingly differently. In the rear intermediate sleeve portion 7" which projects rearwardly from the sleeve-shaped housing 1 and which is thus accessible from the outside there is also a shift mechanism 3 of any desired type which is in connection with an actuating element 11 extending outwardly.

Further disposed in the writing implement is a writing element 2 which in the closure state (FIG. 28) is disposed substantially within the intermediate sleeve 7' and 7" and the closure portion 8 and the nib 26 of which can be sealed in gas-tight manner within the hermetic chamber 6 in the closure portion 8. Furthermore, the rear end of this writing element 2 can be subjected to the action of the shift mechanism 3 or the actuating element 11.

The example of embodiment illustrated (FIGS. 28–28c) corresponds in its functions substantially to the example of embodiment in FIG. 7–7c but as regards the production costs and the practical use is a substantial and fundamental improvement of that embodiment of the writing implement.

The advantages of the example of embodiment of the writing implement shown in FIGS. 28–28c reside firstly in the substantially simplified and cheaper sealing with respect to the housing interior. Although this is achieved as in the example of embodiment according to FIGS. 7–7c by the cooperation of the bend-up segments 34 with the correspondingly adapted tip portion 4 of the writing element 2, in this case the possibly complicated and expensive attachment of the individual sealing bead segments 23 at the bend-up segments 34 is obviated.

On the contrary, in this example of embodiment the individual sealing bead segments 23 are combined to form a sealing bead ring 23' and secured exactly at the point of the writing element tip portion 4 where in the example of embodiment (FIG. 7–7c) of the earlier application they rest during the closure state (FIG. 7) led through the bend-up segments 34 on the tip portion 4 of the writing element 2.

This preferably elastic sealing bead ring 23' is so formed that it completely sealingly fills the peripheral intermediate space remaining when the closure portion 8 is closed between the bend-up segments 34 and writing element tip portion 4 as previously also achieved by the sealing bead segments 23. Together with the tip-side ends of the bend-up segments 34 a smallest possible completely hermetic chamber 6 is produced at a spacing round the nib 26 excluding capillary forces in which also the air supply slits 39 of the writing liquid system (not shown) of the writing element 2 preferably emerging outwardly adjacent the nib 26 can be accommodated. Furthermore, such a sealing bead ring 23' can serve as an additional securing already known from the early application from premature advancing of the writing element 2 because the latter cannot emerge from the closure portion 8 until after complete bending up of the bend-up segments 34, reliably preventing any damage to the nib 26, for example should the thrust transfer from the pressure spring 10 to the pressure spring 9 fail.

Instead of a resilient sealing bead ring 23' and only bending-up resilient radially outwardly biassed bend-up segments 34, conversely the bend-up segments 34 may be made sealingly elastic at the inner side, i.e. provided there for example with a sealing material coating 22 and the sealing bead ring 23' can then be made non-resilient.

With increased sealing requirements both, that is the sealing bead ring 23' and the inside of the bend-up segments 34, can be made sealingly elastic or conversely both can be made so that they are not sealingly elastic and merely fit well against each other.

Locating such an elastic or non-elastic sealing bead ring 23' at the writing element tip portion 4 requires as a rule substantially less expenditure than is necessary to locate the individual sealing bead segments 23 at the bend-up segments 34. Likewise, a sealing bead ring 23' provides the possibility compared with sealing bead segments 23 of reducing the sealing area if the number of bend-up segments 34 is greater than 2, i.e. from seven segments onwards.

Since sealingly elastic materials usually have the property of becoming brittle in the course of time and losing their elasticity, it is also advantageous in the present example of embodiment according to FIGS. 28–28c to renew the sealing bead ring 23' each time the writing element 2 is replaced, it thus regaining its optimum sealing properties, which can be achieved in the above examples of embodiment only by the complete changing of the closure portion 8 with the sealing bead segments 23 disposed therein.

A further essential advantage of the present example of embodiment is that the intermediate sleeve 7' and 7" in this case is formed as it were with a "kink" i.e. a diameter change, and as a result the two pressure springs 9 and 10 necessary for the shift, thrust, etc., coordination can be accommodated in compact manner which makes it possible either to make the writing element 2 of substantially greater volume as shown here (FIGS. 28–28c), or to make the writing implement as a whole substantially thinner, that is by a spring wire thickness ×2, and thus easier to handle. This also eliminates the additional radial projections 36 and 38 in the earlier application which in this case result (FIGS. 28–28c) from the face end 82 of the intermediate sleeve portion 7″ or from the rear-side end 83 of the intermediate sleeve portion 7′.

A fourth advantage to be mentioned of the present embodiment resides in the likewise simplified refill change compared with the previous examples of embodiment (FIG. 7–7c, FIG. 14, FIG. 2). Due to the rearwardly open form of the sleeve-shaped housing 1 and the resulting rearward projection of a portion of the rear intermediate sleeve 7″ it is possible to screw the latter directly on without previous partial removal of the housing 1 or certain parts of the shift mechanism 3. As this is done the writing element 2 moves somewhat to the rear under the biassing pressure of the spring 10 and thus out of any possible anchorings within the closure portion 8 and can now be extracted simultaneously with the rear intermediate sleeve portion 7″ and changed without any problem. If the biassing pressure of the spring 10 is not adequate to push the writing element 2 out of any anchoring engagements within the closure portion 8, it is also possible after loosening the intermediate sleeve connection 70 constructed for example as screw connection to apply pressure again in the direction of the nib to the rear intermediate sleeve portion 7″, whereby the closure portion 8 would briefly open and the writing element 2 would move rapidly rearwardly through a distance equal to the length of the (screw) connection 70.

In FIG. 29 a further particularly advantageous example of embodiment of the writing implement is now illustrated which as regards its sealing and shift functions corresponds substantially also to the example of embodiment of FIGS. 7–7c.

In this case by the specific form of the writing element 2 it is possible to make the closure member 8 in a substantially more simple and cheaper manner and also to further reduce the overall diameter of the writing implement.

In the present example of embodiment the tip portion 4 of the writing element 2 was extended in a manner making it possible to prevent the thickened major portion of the writing element 2 reaching the closure portion 8 during the entire shift and advance operation of the writing element 2 initiated by simple depression of the actuating element 11. This gives completely different conditions as regards the size requirements of the closure portion 8 because its minimum internal diameter is no longer greater than the maximum external diameter of the writing element 2 but need only be greater than the external diameter of the thinner writing element tip portion 4. It now becomes possible to make the closure portion 8 considerably smaller, up to about one quarter of the original mass, which makes a number of improvements possible.

Firstly, such a small cap or closure portion 8 requires less expenditure in production because firstly less material is needed and secondly the number of bend-up segments 34 may be reduced because with decreasing diameter of a longitudinally (e.g. in four parts) divided tube the bending elasticity of its tube segments usually increases.

Furthermore, in this case the technical advantages are achieved that such small closure portions 8 made up moreover of less bend-up segments 34 firstly have considerably less area to be sealed and are thus easier to seal and secondly for generating an equal closure pressure per sq.mm as with a large closure portion require less axial thrust or tension by the spring 9 or by a similarly acting resilient element of any desired type.

As a result, both the spring 9 (or the resilient element 9) provided for generating the closure pressure may be made smaller and this also applies to the further spring 10 stronger compared therewith which apart from its function for the shift mechanism 3 must also control the other spring 9 or set it into a limited movement, the pressure differential between said springs 9 and 10 remaining but being on a lower level.

The smaller springs 9 and 10 possible in this example of embodiment (FIG. 29) thus require less volume and the spring 9 can be accommodated in a peripheral intermediate space remaining round the smaller closure portion 8. The stronger other spring 10 in turn can be accommodated in another peripheral intermediate space which is formed round the lengthened tip portion 4 of the writing element extending into the intermediate sleeve 7.

Due to the fact that the pressure springs 9 and 10 in the present writing implement with their compact tip-side accommodation are removed from the actual main region of the writing element 2, the writing implement can be made slimmer by a spring wire thickness ×2 than is the case in the already diameter-reduced example of embodiment according to FIGS. 28–28c.

A further advantage of this example of embodiment according to FIG. 29 resides in the further improvement and simplification of the sealing of the nib 26 and of any air supply slits 39 rearwardly with respect to the interior of the intermediate sleeve 7. Since the bend-up segments 34 of any diminished closure portion 8 behind the nib 26 already surround the tip portion 4 of the writing element 2 very closely it is only necessary for the rearward sealing to seal the very small peripheral intermediate space between the writing element tip portion 4 and bend-up segments 34 and this can be achieved in the present case in contrast to FIG. 28 simply by an elastic very thin annular sealing material coating 71 round the tip portion 4 of the writing element 2.

In another example of embodiment of the writing implement, not illustrated, it is further possible to bring the bend-up segments 34 not only very close in the region of the sealing material coating 71 in the closure state but into engagement with the writing element tip portion 4 (and each other) and as a result the rearward sealing of the nib 26 is obtained by the specially formed bend-up segments 34 themselves without additionally providing extra seals.

One last improvement to be mentioned of the present example of embodiment is that the sequence of individual shift movements, etc., as illustrated in FIGS. 22a–i, is facilitated by two additional factors, a premature advancing of the writing element 2 or its tip portion 4 through the sealing material coating ring 71 disposed thereon and holding the writing element 2 indisplaceably when the closure portion 8 is closed being avoided.

On the other hand, during the pushbutton movement which effects the hermetic sealing of the writing implement (cf. also FIG. 22e–i) a closing of the closure portion 8 before the writing element 2 has been completely retracted between the intermediate sleeve 7 and closure portion 8 is prevented not only by the still effective pressure transfer of the spring 10 to the spring 9 but additionally by an additional bevelling 72 which is located in the region of the outer side of the closure portion 8 coming into contact with the housing opening 44 during the opening/closing. This additional bevelling 72 effects that the closure portion 8 in the closing retraction firstly bears at a large angle (almost 90° seen from the axis) on the housing opening 44 and this initially makes the closure operation difficult.

By the further diminishing of the button pressure firstly the writing element 2 retracts with the tip portion 4 and the nib 26 completely into the writing implement and thereafter due to the resulting increasing pressure of the spring 9 the closure portion 8 past the additional bevelling 72 comes to bear with its normal bevelling having a smaller angle (almost 0° to the axis) on the housing opening 44. The small-angled normal bevelling now effects at the housing opening 44 accelerated closure of the bend-up segments 34 by the increased deflection of the pressure of the spring 9 into a radially inwardly directed closure pressure until the closure portion 8 is also completely retracted into the writing implement and finally comes to bear on the clamping shoulder 30 of the housing 1, the nib 26 now being sealed in gas-tight manner in the hermetic chamber 6 within the closure portion 8. Thus, the very small closure portion 8 thus also permits a construction which implements the complete retraction of the cap or closure 8 into the writing implement as already provided in FIGS. 23/23*a* in the smallest possible space, and in this case in FIG. 29 the housing extension 29 is made integral with the housing 1.

The refill change is effected basically as in the example of embodiment shown in FIG. 28 but instead of the intermediate sleeve portion 7″ the rear intermediate sleeve closure 60 is correspondingly removed.

In a further example of embodiment of the writing implement (FIG. 30) which also operates by the shift principle of FIG. 22 the closure is achieved in a likewise simplified but greatly modified manner.

The writing implement consists of a sleeve-shaped housing 1 which is bevelled towards the nib 26. Furthermore, disposed therein is a half-shell closure portion 8′ which is preferably provided with only 1–3 bend-up segments 34 which are subjected to biassing pointing away from the tip portion 4′ of the writing element 2 and which at its rear end is preferably integrally connected to a part-shell (e.g. half-shell) intermediate sleeve portion 74 or a shift linkage or the like of the same function. The bend-up segments 34 are in turn provided with integral rearwardly sealing projections 73 which are possibly provided with a sealing material coating 22 which can take over the function of a sealing bead segment 23.

In the writing implement there is further a non-rotational-symmetrical writing element 2′ whose tip portion 4′ is laterally offset so that it can readily be displaced from the inclined sealed tip region of the housing 1 after lateral expansion of the bend-up segments 34 into the writing readiness position.

In this case the hermetic sealing of the nib 26 is achieved firstly by the tip-side edge region of the bend-up segments 34 of the for example half-shell closure portion 8′ impinging on a sealing portion 75 of the housing 1 and thus effecting the outside sealing.

In this case the rearward sealing is achieved firstly by the sealing projections 73 at the bend-up segments 34 impinging on a sealing portion 76 disposed at the writing element tip portion 4′ whilst the other remaining portion of the rearward sealing is achieved by a semicircular projection 77 disposed in the sleeve-shaped housing 1.

Such a writing implement in which bend-up segments 34, or part-shell closure portion 8′, rear sealing projection 23 at the bend-up segments 34, and an only part-shell intermediate sleeve 74 may consist of a single part, can possibly be made even more economically than the examples of embodiment according to FIG. 28 or 29.

Furthermore, the present example of embodiment (FIG. 30) of the writing implement is particularly advantageous as regards its tip-side configuration for sealing of a filler element (not illustrated) because a for example half-shell opening of the closure tip matches to a great extent the conventional form of a fountain pen nib and thus advantageously minimizes the closure portion 8′ therefor.

A final simplification is obtained in this case by replacing the previous pressure springs 9 and 10 by any resilient elements 79 and 80 which have the same function and which control the shift and thrust coordination in the same manner.

In the closure portion 8 illustrated in FIG. 31 of a further example of embodiment of the writing implement the securing of any sealing bead segments 23 is simplified by a two-part construction adapted to be attached to each other.

Whereas the closure portion 8 is established only up to the bearing face 78 the otherwise difficultly accessible tip portions 34′ of the bend-up segments 34 are made individually and provided relatively easily with sealing bead segments 23 or the like and subsequently attached to the corresponding segment stubs. A further simplification is possible here by making the sealing bead segments 23 similar to the sealing projections 73 in FIG. 30 integral with the bend-up segments 34 and possibly providing them with a sealing material coating 22 to retain their full sealing function.

In the closure portion 84 illustrated in FIGS. 32/32*a* of a further embodiment of the writing implement the lateral sealing between the bend-up segments 34 is not achieved by applying sealing material 22 or by exact fitting of the bend-up segments 34 (see FIG. 17) but by very thin-walled segment connections 81 which are disposed between the bend-up segments and which in the closure state (FIG. 32) either contract resiliently or fold inwardly and are then not visible from the outside.

During the writing state (FIG. 32*a*) the segment connections 81 are tensioned or fold similar to an umbrella to such an extent required by the tip-side opening of the bend-up segments 34 of the closure portion 84 for free passage of the writing element 2 (FIG. 32*a*). Such a closure portion 84 may be produced with relatively small expenditure by making it for example in the opened state integrally with the segment connections 81 from a suitable plastic by the injection moulding technique.

A further example of embodiment of the writing implement illustrated in FIG. 33 is particularly equipped for the closure of capillary pens.

The thrust and shift coordination is not achieved here as in the examples of embodiment functioning according to FIGS. 22 and 7–7*c* but in accordance with FIGS. 3–6 and is slightly modified for the example of embodiment described hereinafter (FIG. 33).

The present example of embodiment consists of a usually twopart sleeve-shaped housing 1′ and 31 and disposed therein a rotational asymmetrical capillary writing element 88 with ink cartridge 9, writing capillary 86 and helix exit 89 which is equipped with a laterally disposed shift mechanism 3' (e.g. a heart cam control with control ball).

Furthermore, in the writing implement there is a part-shell (e.g. third-shell) intermediate sleeve 92 at the write-side end of which a part-shell closure portion 8' is disposed which preferably consists of a single bend-up segment 95 and at the rearward end of which an actuating projection 91 is disposed which can be operated via an actuating element 94 which extends outwardly out of the rear portion of the housing 31.

The sealing of the capillary writing element 88 is via the bend-up segment 95 of the part-shell closure portion 8' in dual manner. Firstly, at the inner end side of the bend-up segment 95 there is a rubber elastic sealing element 85 which is provided for the sealing of the writing capillary 86. Secondly the bend-up segment 95 is provided with a (possibly partially rubber-elastic) sealing projection 87 which in the closure condition comes to lie in exact fit over the exit of the ink helix 89.

If the tip-side end of the bend-up segment 95 for instance when actuating pressure is applied to the intermediate sleeve 92 is still disposed outside the front housing portion 1' the axial pressure of the resilient element 80 acting on the bend-up segment 95 is still deflected radially inwardly via the half-side housing opening 44'. However, as soon as the tip portion of the bend-up segment 95 has been retracted completely via the half-side housing opening 44' into the front housing portion 1' (e.g. by dimishing actuating pressure) and there comes to bear on the axis-parallel sliding face 96, the radial pressure deflection of the axial spring pressure is terminated and the bend-up segment 95 is now moved exactly axially in the direction of the capillary writing element 88. As a result the sealing element 85 is pressed axially against the tip-side opening of the writing capillary 86 and the sealing projection 87 against the helix exit 89, the bend-up segment 95 being additionally guided there by the location shoulder 93.

To reach the writing condition a simple pressure actuation is effected, either of the actuating element 94 or with the rear housing portion 31 screwed off (substantially screwed in a circle) of the actuating projection 91 of the part-shell intermediate sleeve 92.

The closure portion 95 thereby first moves a distance axially in the write-side direction. The sealing element 85 detaches from the capillary 86 without bending it because the axis-parallel slide face 96 initially prevents a lateral displacement of the bend-up segment 95 whilst the capillary writing element 88 does not move because this is prevented by the pressure of the resilient element 79 (or the pressure spring 9) which expands by a corresponding distance. In the meantime the sealing projection 87 of the bend-up segment 95 likewise detaches from the helix exit 89. By the axial advance movement after a short distance exactly sufficient to permit opening of the capillary tube 86 of the helix exit 89 the intermediate sleeve shoulder 98 reaches the limit projection 97 of the capillary writing element 88 and as a result the latter is now also entrained.

From this instant onwards the closure portion 8' moves together with the capillary writing element 88 in the axial write-side direction, the tip portion of the bend-up segment 95 moving past the half-side housing opening 44' out of the front housing portion 1' and thereby moving due to its radially outwardly directed biassing from the axial region into a laterally offset position. This advance movement continues until the lateral shift or switching mechanism 3' of the capillary writing element 88 changes over. With this changeover the advance by the pressure actuation is terminated and the pressure diminishes. With the diminishing actuating pressure the capillary writing element 88 now engages by means of its shift mechanism 3' into the advanced writing position.

The renewed acting pressure of the strong resilient element 80 then pulls the part-shell intermediate sleeve 92 with the part-shell closure portion 81 attached thereto or the bend-up segment 95 meanwhile laterally bent away in its tip portion back in the direction of the housing interior.

Meanwhile, firstly the weaker resilient element 76 bearing with its rear end against the externally engaged capillary writing element 88 is compressed via the intermediate sleeve shoulder 98 by the stronger resilient element 80. Secondly, the laterally bent-away bend-up segment 95 and its tip portion is drawn past the writing capillary 86 and the tip of the externally engaged capillary writing element 88 laterally in the rearward direction, the complete nib of the capillary writing element 88 being completely exposed.

With the then occuring radially inwardly directed pressure effected through the half-side housing opening 44' on the bend-up segment 95 the latter then finally engages laterally withdrawn on the capillary writing element 88, the pressure of the resilient element 80 being supported between the half-side housing opening 44' and the tip of the bend-up segment 95 which presses laterally onto the capillary writing element 88, additionally contributing to the stable fixing thereof. On the pressure actuation effecting the closure of the writing implement the described movement, thrust and shift sequences take place in the reverse order.

I claim:

1. A writing implement comprising:

(a) a housing;

(b) an elongated writing member comprising a writing nib assembly having a writing tip, and an ink reservoir rearward of said tip, said ink reservoir being filled with evaporatable ink, and said ink reservoir being fluidically coupled to said writing nib assembly;

(c) a plurality of sealing members supported on said housing and together forming a segmented sealing assembly, said sealing assembly comprising:

(i) a plurality of rearward sealing segment portions, said rearward sealing segment portions being configured and dimensioned in a first position to sealingly engage said cartridge; and (ii) a plurality of tipward sealing segment portions, said tipward sealing segment portions, each being configured and dimensioned in said first position to sealingly engage others of said tipward sealing segment portions; said tipward sealing segment portions and said rearward sealing segment portions together in said first position forming a sealed chamber disposed around said writing tip; and (d) a sealing spring under mechanical bias in said first position and coupled to said segmented sealing assembly and exerting a sealing mechanical force closing said sealing assembly by forcing said rearward and tipward sealing segments against each other and against said writing member to form said chamber.

2. A writing implement as in claim 1, wherein said rearward and tipward sealing segments, and said elongated writing member bear against each other at pairs of facing sealing surfaces, and wherein at least one surface of said pair of facing sealing surfaces of each of said pairs comprises a layer of sealing elastic material secured to a relatively inelastic material.

3. A writing implement as in claim 2, wherein said relatively inelastic material comprises relatively inelastic plastic or metal.

4. A writing implement as in claim 1, wherein said housing defines an axis, and said sealing spring exerts a force along the axis of said housing, further comprising:

(e) at least one support surface positioned on the inside of said housing;

(f) at least one mating support surface positioned on the outside of said sealing assembly, said sealing assembly being positioned partly within said housing and said support surface being positioned tipwardly of said mating support surface;

(g) an angled cam surface defined by each of said sealing members, said angled surface diverging outwardly from said axis in the tipward direction; and (h) a pressure surface defined on the tipward portion of said housing, said pressure surface bearing against said angled cam surface to urge said sealing members toward each other and said nib assembly to form said chamber in said first position.

5. A writing implement as in claim 4, wherein said spring comprises metal.

6. A writing implement as in claim 5, further comprising:

(i) an actuator mounted on said housing and coupled to said sealing assembly for urging said sealing assembly in a direction toward said nib assembly to cause forward movement of said sealing assembly to a second position, and release of said sealing mechanical force.

7. A writing implement as in claim 6, wherein said sealing member comprises an opening member for urging said sealing segment portions apart in response to forward movement of said actuator.

8. A writing implement as in claim 7, wherein said opening member urges said sealing segment portions apart substantially without applying any force to said sealing segment portions.

9. A writing implement as in claim 8, further comprising:

(j) a second spring bearing against said writing member and said sealing assembly and urging said writing member rearwardly.

10. A writing implement as in claim 1, wherein said sealing assembly further comprises resilient support arms for resiliently supporting said sealing members, said support arms having a circumferential dimension smaller than said tipward and rearward sealing segments.

11. A writing implement as in claim 4, wherein said rearward and tipward sealing segments, and said elongated writing member bear against each other at pairs of facing sealing surfaces, and wherein at least one surface of said pair of facing sealing surfaces of each of said pairs comprises a layer of sealingly elastic material secured to a relatively inelastic material.

12. A writing implement as in claim 6, wherein said sealing assembly further comprises spring biased support arms for resiliently supporting said sealing members and urging them outward radially from said axis.

13. In a writing implement of the type having a reservoir of ink and a writing point fluidically coupled to said reservoir and having the characteristic of having a quantity of evaporatable ink contained in said reservoir and exposed on said writing point, and having an actuator mechanism for urging said writing point into and out of a pen housing, the improvement comprising a plurality of tipward sealing segments and a plurality of cooperating rearward sealing segments which are urged toward each other and said writing point by a metal spring in response to a first actuation of said actuator to form a small airtight chamber around said writing point and are separated from each other in response to a second actuation of said actuator to allow said writing point to extend therefrom during writing.

* * * * *